US008773343B2

(12) United States Patent
Fujikawa

(10) Patent No.: US 8,773,343 B2
(45) Date of Patent: Jul. 8, 2014

(54) LCD WHEREIN THE POLARITY OF THE FINAL SUBFIELD OF A FIELD IS KEPT THE SAME AS THE POLARITY OF FIRST SUBFIELD OF THE NEXT SUBFIELD BY INVERTING THE POLARITY OF THE CAPACITIVE POTENTIAL LINES TWICE DURING THE FINAL SUBFIELD

(75) Inventor: Shinsuke Fujikawa, Chino (JP)

(73) Assignee: Seiko Epson Corporation, Tokyo (JP)

( * ) Notice: Subject to any disclaimer, the term of this patent is extended or adjusted under 35 U.S.C. 154(b) by 174 days.

(21) Appl. No.: 12/946,969

(22) Filed: Nov. 16, 2010

(65) Prior Publication Data

US 2011/0115779 A1 May 19, 2011

(30) Foreign Application Priority Data

Nov. 19, 2009 (JP) ..... 2009-263670

(51) Int. Cl.
*G09G 3/36* (2006.01)

(52) U.S. Cl.
USPC ..... 345/96

(58) Field of Classification Search
CPC ..... G09G 3/3614; G09G 2310/025; G09G 3/2018–3/2204; G09G 2320/0266
USPC ..... 345/87–104, 208, 691–692
See application file for complete search history.

(56) References Cited

U.S. PATENT DOCUMENTS

| | | | | |
|---|---|---|---|---|
| 2002/0036610 | A1* | 3/2002 | Ito et al. | 345/89 |
| 2002/0044113 | A1* | 4/2002 | Ishiyama | 345/87 |
| 2002/0084969 | A1* | 7/2002 | Ozawa | 345/96 |
| 2005/0162363 | A1* | 7/2005 | Kim | 345/92 |
| 2005/0168455 | A1* | 8/2005 | Murai et al. | 345/204 |
| 2007/0018928 | A1* | 1/2007 | Ludden | 345/96 |
| 2008/0074377 | A1* | 3/2008 | Fujita | 345/96 |
| 2008/0074568 | A1* | 3/2008 | Tanaka et al. | 349/37 |
| 2009/0079767 | A1* | 3/2009 | Morita | 345/690 |
| 2009/0121993 | A1* | 5/2009 | Masumura | 345/88 |
| 2011/0115768 | A1* | 5/2011 | Hara | 345/208 |

FOREIGN PATENT DOCUMENTS

| | | |
|---|---|---|
| JP | 2002-196358 A | 7/2002 |
| JP | 2003-114661 A | 4/2003 |

* cited by examiner

*Primary Examiner* — Chanh Nguyen
*Assistant Examiner* — Navin Lingaraju
(74) *Attorney, Agent, or Firm* — Lowe Hauptman & Ham, LLP

(57) ABSTRACT

A liquid crystal device includes a capacitive electric potential line driving circuit that supplies one of a low-level and a high-level electric potential as a capacitive electric potential to each of the capacitive electric potential lines, reverses polarity of the capacitive electric potential as a write period for the row corresponding to the corresponding capacitive electric potential line is terminated in each subfield period included in a unit period, and, in a final subfield period included in the unit period, reverses polarity of the capacitive electric potential again at the time period of after reversing the polarity of the capacitive electric potential until terminating the corresponding final subfield period.

5 Claims, 21 Drawing Sheets

FIG. 11

| POL1 | POL2 | PERIOD | Vcom[m] |
|---|---|---|---|
| VH | VL | START OF WRITE PERIOD H[m−1] — START OF WRITE PERIOD H[m+1] | VcomL |
| | | START OF WRITE PERIOD H[m+1] — START OF NEXT WRITE PERIOD H[m−1] | VcomH |
| VL | VH | START OF WRITE PERIOD H[m−1] — START OF WRITE PERIOD H[m+1] | VcomH |
| | | START OF WRITE PERIOD H[m+1] — START OF NEXT WRITE PERIOD H[m−1] | VcomL |

FIG. 13

| GRADATION | VOLTAGE APPLICATION PATTERN (WEIGHTED SUBFIELD AC DRIVING) | | | | | | | | POLARITY COMPARISON |
|---|---|---|---|---|---|---|---|---|---|
| | (k)th FRAME | | | | (k+1)th FRAME | | | | |
| | SF1(+) | SF2(−) | SF3(+) | SF4(−) | SF1(−) | SF2(+) | SF3(−) | SF4(+) | |
| 0 | 0 | 0 | 0 | 0 | 0 | 0 | 0 | 0 | ∫+5dt=∫−5dt |
| 1 | +5 | 0 | 0 | 0 | −5 | 0 | 0 | 0 | ∫+5dt=∫−5dt |
| 2 | 0 | −5 | 0 | 0 | 0 | +5 | 0 | 0 | ∫+5dt=∫−5dt |
| 3 | +5 | −5 | 0 | 0 | −5 | +5 | 0 | 0 | ∫+5dt=∫−5dt |
| 4 | 0 | 0 | +5 | 0 | 0 | 0 | −5 | 0 | ∫+5dt=∫−5dt |
| 5 | +5 | 0 | +5 | 0 | −5 | 0 | −5 | 0 | ∫+5dt=∫−5dt |
| 6 | 0 | −5 | +5 | 0 | 0 | +5 | −5 | 0 | ∫+5dt=∫−5dt |
| 7 | +5 | −5 | +5 | 0 | −5 | +5 | −5 | 0 | ∫+5dt=∫−5dt |
| 8 | 0 | 0 | 0 | −5 | 0 | 0 | 0 | +5 | ∫+5dt=∫−5dt |
| 9 | +5 | 0 | 0 | −5 | −5 | 0 | 0 | +5 | ∫+5dt=∫−5dt |
| 10 | 0 | −5 | 0 | −5 | 0 | +5 | 0 | +5 | ∫+5dt=∫−5dt |
| 11 | +5 | −5 | 0 | −5 | −5 | +5 | 0 | +5 | ∫+5dt=∫−5dt |
| 12 | 0 | 0 | +5 | −5 | 0 | 0 | −5 | +5 | ∫+5dt=∫−5dt |
| 13 | +5 | 0 | +5 | −5 | −5 | 0 | −5 | +5 | ∫+5dt=∫−5dt |
| 14 | 0 | −5 | +5 | −5 | 0 | +5 | −5 | +5 | ∫+5dt=∫−5dt |
| 15 | +5 | −5 | +5 | −5 | −5 | +5 | −5 | +5 | ∫+5dt=∫−5dt |

t

FIG. 28

| GRADATION | VOLTAGE APPLICATION PATTERN (WEIGHTED SUBFIELD AC DRIVING) | | | | | | | | POLARITY COMPARISON |
|---|---|---|---|---|---|---|---|---|---|
| | (k)th FRAME | | | | (k+1)th FRAME | | | | |
| | SF1(+) | SF2(−) | SF3(+) | SF4(−) | SF1(+) | SF2(−) | SF3(+) | SF4(−) | |
| 0 | 0 | 0 | 0 | 0 | 0 | 0 | 0 | 0 | ∫+5dt=∫−5dt |
| 1 | +5 | 0 | 0 | 0 | +5 | 0 | 0 | 0 | ∫+5dt>∫−5dt |
| 2 | 0 | −5 | 0 | 0 | 0 | −5 | 0 | 0 | ∫+5dt<∫−5dt |
| 3 | +5 | −5 | 0 | 0 | +5 | −5 | 0 | 0 | ∫+5dt<∫−5dt |
| 4 | 0 | 0 | +5 | 0 | 0 | 0 | +5 | 0 | ∫+5dt>∫−5dt |
| 5 | +5 | 0 | +5 | 0 | +5 | 0 | +5 | 0 | ∫+5dt>∫−5dt |
| 6 | 0 | −5 | +5 | 0 | 0 | −5 | +5 | 0 | ∫+5dt>∫−5dt |
| 7 | +5 | −5 | +5 | 0 | +5 | −5 | +5 | 0 | ∫+5dt>∫−5dt |
| 8 | 0 | 0 | 0 | −5 | 0 | 0 | 0 | −5 | ∫+5dt<∫−5dt |
| 9 | +5 | 0 | 0 | −5 | +5 | 0 | 0 | −5 | ∫+5dt<∫−5dt |
| 10 | 0 | −5 | 0 | −5 | 0 | −5 | 0 | −5 | ∫+5dt<∫−5dt |
| 11 | +5 | −5 | 0 | −5 | +5 | −5 | 0 | −5 | ∫+5dt<∫−5dt |
| 12 | 0 | 0 | +5 | −5 | 0 | 0 | +5 | −5 | ∫+5dt<∫−5dt |
| 13 | +5 | 0 | +5 | −5 | +5 | 0 | +5 | −5 | ∫+5dt<∫−5dt |
| 14 | 0 | −5 | +5 | −5 | 0 | −5 | +5 | −5 | ∫+5dt<∫−5dt |
| 15 | +5 | −5 | +5 | −5 | +5 | −5 | +5 | −5 | ∫+5dt<∫−5dt |

t

LCD WHEREIN THE POLARITY OF THE FINAL SUBFIELD OF A FIELD IS KEPT THE SAME AS THE POLARITY OF FIRST SUBFIELD OF THE NEXT SUBFIELD BY INVERTING THE POLARITY OF THE CAPACITIVE POTENTIAL LINES TWICE DURING THE FINAL SUBFIELD

BACKGROUND

1. Technical Field

The present invention relates to a driving method of a liquid crystal device.

2. Related Art

During the driving of the liquid crystal device, an alternating current (AC) driving in which the polarity of the voltage applied to the liquid crystal element is repeatedly reversed is generally used to suppress degradation of the liquid crystal device caused by the remaining direct current (DC) components. As a method of the AC driving, JP-A-2002-196358 discloses a driving method in which an output range of the signal line driving circuit for writing an electric potential to pixel electrodes of the liquid crystal elements is reduced by supplying signals to signal lines and the voltage applied to the liquid crystal element is set to a desired voltage by altering the electric potential written to the pixel electrode using a capacitive coupling to suppress power consumption. Hereinafter, this driving method is called "capacitive line driving." In this capacitive line driving disclosed in JP-A-2002-196358, the polarity of the voltage applied to the liquid crystal element is reversed whenever the electric potential is written to the pixel electrode.

In addition, as a method of driving a liquid crystal device, a subfield driving is known in the art, in which a single frame is divided into a plurality of subfields, and multiple gradations are displayed on the liquid crystal element by applying either one of two voltages (absolute values) to the liquid crystal element in each subfield. JP-A-2003-114661 discloses, as an example of the subfield driving, a driving method in which the lengths of a plurality of subfields included in a single frame are different in order to reduce the number of subfields. Hereinafter, this driving method is called a "weighted subfield driving."

Herein, to obtain the advantages of both the capacitive line driving disclosed in JP-A-2002-196358 and the weighted subfield driving, it is assumed that both driving methods are combined. In this case, if the number of subfields per single frame is even, a problem occurs. This problem will be described with reference to FIG. 28. In this description, the liquid crystal device obtained by combining both driving methods is called a "liquid crystal device in the related art."

Referring to FIG. 28, voltage patterns applied to a normally black type liquid crystal element are illustrated across the (k)th frame and the (k+1)th frame in the case where, in the liquid crystal device in the related art, the number of subfields per single frame is set to 4, and a total of 16 gradations, from the 0th gradation to the 15th gradation, are displayed. For expressions corresponding to each gradation, there are shown comparative expressions between a time integral (absolute value) of positive voltages and a time integral value (absolute value) of negative voltages applied to the corresponding liquid crystal element 40 in the case where the gradations are displayed across the (k)th frame and the (k+1)th frame.

According to the capacitive line driving disclosed in JP-A-2002-196358, polarity of the voltage applied to the liquid crystal element is reversed whenever an electric potential is written to the pixel electrode. Meanwhile, according to the subfield driving, the writing of electric potentials to the pixel electrode is performed for each subfield. Therefore, in the liquid crystal device of the related art, as shown in FIG. 28, the polarity of the voltage applied to the liquid crystal element is reversed for each subfield. In other words, the subfield for which the polarity of the voltage applied to the liquid crystal element is positive (+) and the subfield for which the polarity of the voltage applied to the liquid crystal element is negative (−) are alternately arranged.

Therefore, the polarity relating to the subfield within the (k)th frame and the polarity relating to the subfield within the (k+1)th frame having the same length as that of the corresponding subfield are opposite to each other when the number of subfields per single frame is odd. Otherwise, if the number is even, the polarity is not opposite. For example, when focusing on the 7th gradation, the applied voltage relating to the subfield SF1 is set to +5 V even in both the (k)th and (k+1)th frames. Therefore, when the number of subfields per single frame is even, the comparative expressions become inequality expressions except for the 0th gradation, as shown in FIG. 28.

This means that the DC components remain except for the 0th gradation. The remaining DC components accelerate the degradation of the liquid crystal element.

SUMMARY

In this regard, the invention provides a liquid crystal device, a driving method thereof, and an electronic apparatus capable of avoiding remaining DC components even when the number of subfields per unit time period is even while both the capacitive line driving and the weighted subfield driving are employed.

According to an aspect of the invention, there is provided a method of driving a liquid crystal device including a signal line, a capacitive electric potential line, a liquid crystal element having a pixel electrode and a common electrode to which a common electric potential is supplied, a retentive capacitor interposed between the pixel electrode and the capacitive electric potential line, and a selection switch interposed between the signal line and the pixel electrode, the method including: structuring a unit period with even-numbered subfield periods including subfield periods having different lengths and supplying either one of a first electric potential and a second electric potential to the signal line in a write period included in each of the even-numbered subfield periods; writing an electric potential of the signal line to the pixel electrode by performing control such that the selection switch is turned on in the write period; and supplying either one of a low-level electric potential and a high-level electric potential as a capacitive electric potential to the capacitive electric potential line, reversing polarity of the capacitive electric potential as the write period is terminated in each subfield period included in the unit period, and, in a final subfield period included in the unit period, reversing polarity of the capacitive electric potential again after reversing the polarity of the capacitive electric potential until terminating the corresponding final subfield period.

In this driving method, in each of the subfield periods included in a unit period, the polarity of the capacitive electric potential is reversed as the write period is terminated, and in the final subfield period included in a unit period, a process (first process) of reversing the polarity of the capacitive electric potential again at the time period after the polarity of the capacitive electric potential is reversed until the corresponding final subfield period is terminated is performed. Therefore, when the number of subfield periods included in a unit period is set to q (even number), the polarity of the capacitive electric potential is reversed q+1 (odd number) times in each unit period. That is, between the two neighboring unit periods in the corresponding subfield period having the same length, the reversing direction of the capacitive electric potential becomes the opposite direction. Therefore, during the two neighboring unit periods, the DC component of the voltage applied to the liquid crystal element is removed. That is, according to this driving method, it is possible to avoid the remnant DC components.

The "polarity reversing" refers to a process of transitioning the capacitive electric potential from negative polarity to positive polarity or from positive polarity to negative polarity when a high electric potential is set to positive polarity, and the low electric potential is set to negative polarity as a reference to an average electric potential of both electric potentials in the case where two values are used as the capacitive electric potential.

According to another aspect of the invention, there is provided a method of driving a liquid crystal device including a signal line, a capacitive electric potential line, a liquid crystal element having a pixel electrode and a common electrode to which a common electric potential is supplied, a retentive capacitor interposed between the pixel electrode and the capacitive electric potential line, and a selection switch interposed between the signal line and the pixel electrode, the method including: structuring a unit period with even-numbered subfield periods including subfield periods having different lengths and supplying either one of a first electric potential and a second electric potential to the signal line in a write period included in each of the even-numbered subfield periods; writing an electric potential of the signal line to the pixel electrode by performing control such that the selection switch is turned on in the write period; and supplying either one of a low-level electric potential and a high-level electric potential as a capacitive electric potential to the capacitive electric potential line, reversing polarity of the capacitive electric potential as the write period is terminated in each subfield period included in the unit period, in the subfield periods except for a final subfield period out of the subfield periods included in the unit period, reversing polarity of the capacitive electric potential again after reversing the polarity of the capacitive electric potential until terminating the corresponding subfield period, and maintaining the polarity of the capacitive electric potential after reversing the polarity of the capacitive electric potential until terminating the corresponding subfield period in the final subfield period.

In this driving method, a process (second process) of reversing the polarity of the capacitive electric potential as the write period is terminated in each subfield period included in the unit period, in the subfield periods except for a final subfield period out of the subfield periods included in the unit period, reversing the polarity of the capacitive electric potential again at the time period of after reversing the polarity of the capacitive electric potential until terminating the corresponding subfield period, and in the final subfield period, maintaining the polarity of the capacitive electric potential at the time period of after reversing the polarity of the capacitive electric potential until terminating the corresponding subfield period is performed. Therefore, when the number of subfields included in the unit period is set to q (even number), the polarity of the capacitive electric potential is reversed $2\times q-1$ (odd number) times for each unit period. That is, between the two neighboring unit periods in the corresponding subfield period having the same length, the reversing direction of the capacitive electric potential becomes the opposite direction. Therefore, in the two neighboring unit periods, the DC component of the voltage applied to the liquid crystal element is removed. That is, according to this driving method, the remaining DC component can be avoided.

According to another aspect of the invention, there is provided a liquid crystal device including a plurality of signal lines, a plurality of scanning lines, a plurality of capacitive electric potential lines, and pixel circuits provided in each intersection between a plurality of the signal lines and a plurality of the scanning lines, each of the pixel circuits including a liquid crystal element having a pixel electrode and a common electrode to which a common electric potential is supplied, a retentive capacitor interposed between the pixel electrode and the capacitive electric potential line, and a selection switch interposed between the signal line and the pixel electrode, the liquid crystal device including: a signal line driving circuit that structures a unit period such as a frame with even-numbered subfield periods including subfield periods having different lengths and supplies either one of a first electric potential and a second electric potential to the signal line in a write period included in each of the even-numbered subfield period; a scanning line driving circuit that sequentially selects a plurality of the scanning lines and supplies a scanning signal for turning on the selection switch in each write period; and a capacitive electric potential line driving circuit that supplies either one of a low-level electric potential and a high-level electric potential as a capacitive electric potential to each of the capacitive electric potential lines, reverses polarity of the capacitive electric potential as the write period for the row corresponding to the corresponding capacitive electric potential line is terminated in each subfield period included in the unit period, and, in a final subfield period included in the unit period, reverses polarity of the capacitive electric potential again after reversing the polarity of the capacitive electric potential until terminating the corresponding final subfield period.

In this liquid crystal device, it is possible to avoid the remnant DC component through the first process.

In the case where the direction (push direction) of reversing the polarity of the capacitive electric potential executed as the write period is terminated is different in each subfield period, a portion (refer to FIG. 14) in which the electric potential of the pixel electrode is significantly different between the neighboring rows in each subfield period scans the display area so that the display quality degradation such as contrast degradation is generated. However, in the first process, since the push direction is identical between the final subfield period of any unit period and the first subfield period of the next unit period, the number of scanning using the aforementioned portion is reduced. That is, according to the liquid crystal device, it is possible to improve the display quality.

However, focusing on a single frame even in the liquid crystal device, the DC component remains. However, in the first process, since the push direction is reversed in each subfield period in principle, even when a single unit period is focused, it is possible to suppress the maximum value (absolute value) of the remnant DC component as small as possible. This contributes to the suppression of degradation in the liquid crystal element.

According to another aspect of the invention, there is provided a liquid crystal device including a plurality of signal lines, a plurality of scanning lines, a plurality of capacitive electric potential lines, and pixel circuits provided in each intersection between a plurality of the signal lines and a plurality of the scanning lines, each of the pixel circuits including a liquid crystal element having a pixel electrode and a common electrode to which a common electric potential is supplied, a retentive capacitor interposed between the pixel electrode and the capacitive electric potential line, and a selection switch interposed between the signal line and the pixel electrode, the liquid crystal device including: a signal line driving circuit that structures a unit period such as a frame with even-numbered subfield periods including subfield periods having different lengths and supplies either one of a first electric potential and a second electric potential to the signal line in a write period included in each of the even-numbered subfield period; a scanning line driving circuit that sequentially selects a plurality of the scanning lines and supplies a scanning signal for turning on the selection switch in each write period; and a capacitive electric potential line driving circuit that supplies either one of a low-level electric potential and a high-level electric potential as a capacitive electric potential to each of the capacitive electric potential lines, reverses polarity of the capacitive electric potential as the write period is terminated in each subfield period included in the unit period, in the subfield periods except for a final subfield period out of the subfield periods included in the unit period, reverses polarity of the capacitive electric potential again after reversing the polarity of the capacitive electric potential until terminating the corresponding subfield period, and maintaining the polarity of the capacitive electric potential after reversing the polarity of the capacitive electric potential until terminating the corresponding subfield period in the final subfield period.

In this liquid crystal device, since the second process is performed, it is possible to avoid the remnant DC component. In the second process, since the push direction is common within the unit period, frequency of the scanning using a portion (refer to FIG. 14) where the electric potential of the pixel electrode between the neighboring rows is significantly different is significantly reduced. Therefore, according to this liquid crystal device, it is possible to significantly improve the display quality.

According to another aspect of the invention, there is provided a liquid crystal device including a plurality of signal lines, a plurality of scanning lines, a plurality of capacitive electric potential lines, and pixel circuits provided in each intersection between a plurality of the signal lines and a plurality of the scanning lines, each of the pixel circuits including a liquid crystal element having a pixel electrode and a common electrode to which a common electric potential is supplied, a retentive capacitor interposed between the pixel electrode and the capacitive electric potential line, and a selection switch interposed between the signal line and the pixel electrode, the liquid crystal device including: a signal line driving circuit that structures a unit period such as a frame with even-numbered subfield periods including subfield periods having different lengths and supplies either one of a first electric potential and a second electric potential to the signal line in a write period included in each of the even-numbered subfield period; a scanning line driving circuit that sequentially selects a plurality of the scanning lines and supplies a scanning signal for turning on the selection switch in each write period; and a capacitive electric potential line driving circuit that selectively performs either one of a first process and a second process for supplying either one of a low-level electric potential and a high-level electric potential as a capacitive electric potential to each of the capacitive electric potential lines, wherein, in the first process, the polarity of the capacitive electric potential is reversed as the write period of the row corresponding to the corresponding capacitive electric potential line in each subfield period included in the unit period is terminated, and the polarity of the capacitive electric potential is reversed again after reversing the polarity of the capacitive electric potential until terminating the corresponding final subfield period in the final subfield period included in the unit period, and wherein, in the second process, the polarity of the capacitive electric potential is reversed as the write period is terminated in each subfield period included in the unit period, the polarity of the capacitive electric potential is reversed again after reversing the capacitive electric potential until terminating the corresponding subfield period in the subfield periods except for a final subfield period out of the subfield periods included in the unit period, and the polarity of the capacitive electric potential is maintained after reversing the polarity of the capacitive electric potential until terminating the corresponding subfield period in the final subfield period.

In this liquid crystal device, since the first process or the second process is executed, it is possible to avoid the remnant DC component. In the liquid crystal device, the process executed by the capacitive electric potential line driving circuit is selected based on the type of the image to be displayed. In such a liquid crystal device, the liquid crystal device may execute the second process when a moving picture insusceptible to an afterimage phenomenon is displayed and execute the first process when a still image susceptible to an afterimage phenomenon is displayed. The liquid crystal device may execute the second process when a natural image (such as a photograph) insusceptible to an afterimage phenomenon is displayed and execute the first process when a computer graphics (such as a menu image) susceptible to an afterimage phenomenon is displayed.

However, as the first process, it is preferable that the polarity of the capacitive electric potential is reversed during the final subfield period included in the unit period, and then, the polarity of the capacitive electric potential is reversed again at the time point preceding the length of the write period from the end of the final subfield period to the end of the corresponding final subfield period. In this process, it is possible to sufficiently suppress degradation in accuracy of the gradation display caused by the repeated reversing. In addition, as the second process, it is preferable that the polarity of the capacitive electric potential is reversed in the subfield periods except for the final subfield period out of the subfield periods included in the unit period, and then, the polarity of the capacitive electric potential is reversed again at the time point preceding the length of the write period from the end of the corresponding subfield period to the end of the corresponding subfield period. In this process, it is possible to sufficiently suppress the degradation in accuracy of the gradation display caused by the repeated reversing.

Each of the liquid crystal devices described above may include a polarity signal generation circuit that generates a first polarity signal and a second polarity signal. The capacitive electric potential line driving circuit may select one of the low-level electric potential and the high-level electric potential as the capacitive electric potential based on the first polarity signal in the write period assigned by the scanning signal corresponding to a row preceding a single row from the row of the corresponding capacitive electric potential line, maintain the immediately previous capacitive electric potential in the write period of the corresponding row, and in the write period assigned by the scanning signal corresponding to the row following the row of the corresponding capacitive electric potential line by a single row, select one of the low-level electric potential and the high-level electric potential as the capacitive electric potential based on a second polarity signal. In this liquid crystal device, it is possible to appropriately change the capacitive electric potential just by appropriately setting the first and second polarity signals.

In the liquid crystal device described above, the capacitive electric potential line driving circuit may include a sampling circuit provided in each of the capacitive electric potential lines and a selection circuit that selects one of the low-level electric potential and the high-level electric potential based on the output signals of the sampling circuit. The sampling circuit may include a first switch having one terminal to which the first polarity signal is supplied and the other terminal connected to a first node, a second switch having one terminal to which the first node is connected, a third switch having one terminal to which the second polarity signal is supplied and the other terminal connected to the first node, a buffer circuit having an input terminal connected to the first node and an output terminal connected to a second node, and a fourth switch having one terminal connected to the second node and the other terminal connected to the other terminal of the second switch. The control terminals of the first and second switches may be supplied with the scanning signal corresponding to a row preceding a single row from the row of the corresponding capacitive electric potential line to exclusively turn on the third and fourth switches, and control terminals of the first and third switches may be supplied with the scanning signal corresponding to a row following a single row from the row of the corresponding capacitive electric potential line to exclusively turn on the third and fourth switches.

In this configuration, even when the selection direction for a plurality of scanning lines is changed, the capacitive electric potential can be appropriately changed just by interchanging the first and second polarity signals. Therefore, if a polarity signal supply circuit is provided in the liquid crystal device having such a configuration to interchange the first and second polarity signals in synchronization with the selection direction for a plurality of scanning lines, the capacitive electric potential line driving circuit can change the capacitive electric potential in synchronization with the selection direction for a plurality of scanning lines without supplying the signal representing the selection direction for a plurality of scanning lines.

Each of the aforementioned liquid crystal devices may be used in various electronic apparatuses. In a typical example of the electronic apparatus, the liquid crystal device may be used as a display device. Specifically, a mobile phone or a PDA may be an example of the electronic apparatus according to the invention. In addition, the concept of the electronic apparatus according to the invention also includes a projection type display device using the liquid crystal device according to the aforementioned aspects of the invention as a light modulator for modulating the output light from a light source. The projection type display device includes a light source for outputting light beams, the liquid crystal device according to various aspects described above for modulating the output light from the light source, and an optical system for projecting the light modulated by the liquid crystal device onto a projection plane.

BRIEF DESCRIPTION OF THE DRAWINGS

The invention will be described with reference to the accompanying drawings, wherein like numbers reference like elements.

FIG. 11 illustrates input/output characteristics of the unit circuit.

FIG. 13 is a conceptual diagram illustrating advantages of the liquid crystal device.

FIG. 28 is a conceptual diagram illustrating disadvantages of the liquid crystal device of the related art.

DESCRIPTION OF EXEMPLARY EMBODIMENTS

1. First Embodiment

Figure 1:
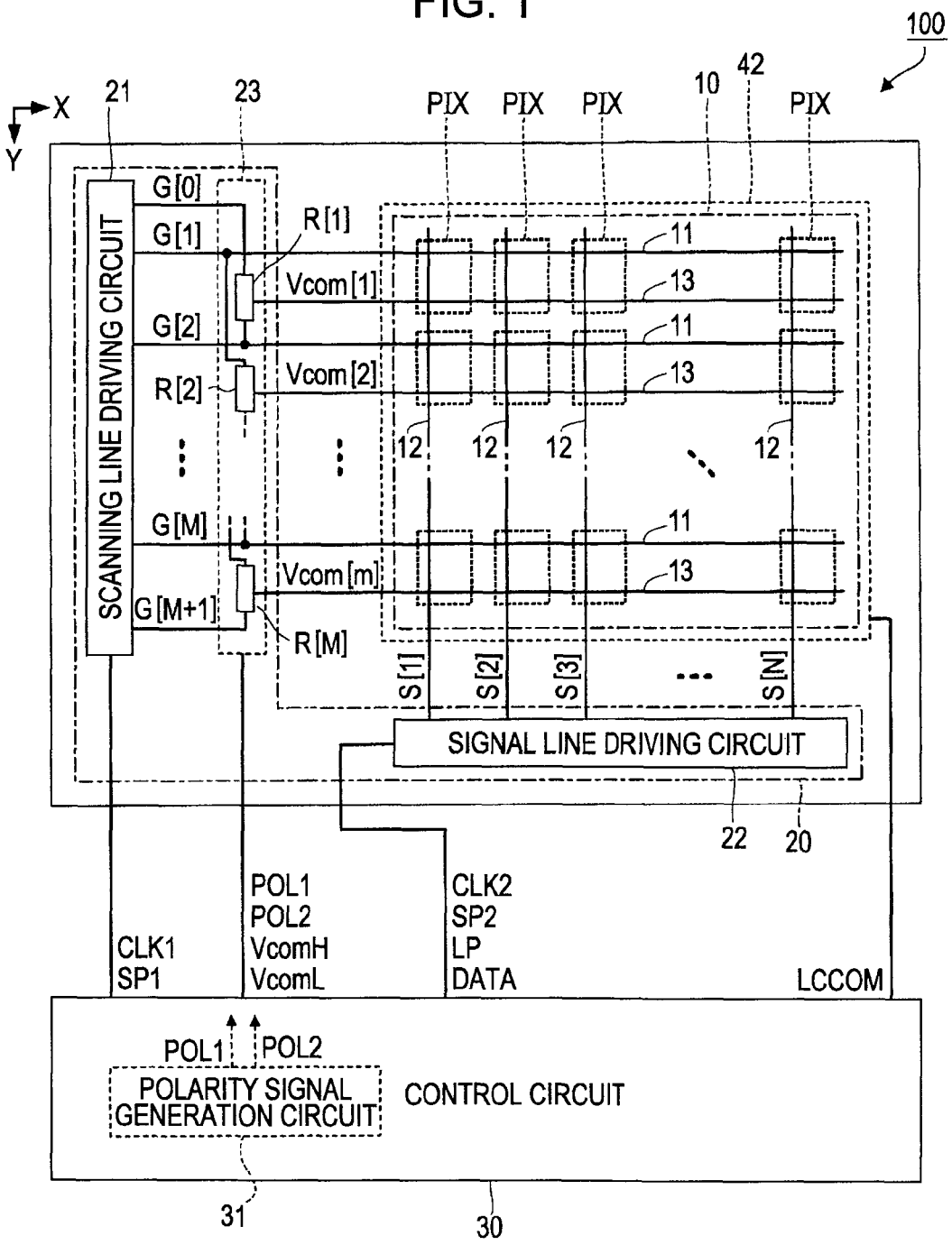
FIG. 1 is a block diagram illustrating a configuration of the liquid crystal device according to the first embodiment of the invention.

FIG. 1 is a block diagram illustrating a configuration of the liquid crystal device 100 according to the first embodiment of the invention. The liquid crystal device 100 is a liquid crystal device employed in various electronic apparatuses as a display body for displaying images. The liquid crystal device 100 includes an element portion (display area) 10 where a plurality of pixel circuits PIX are arranged on a plane, a driving circuit 20 for driving each pixel circuit PIX in an alternating current (AC) driving mode, and a control circuit 30 for controlling the driving circuit 20. The driving circuit 20 includes a scanning line driving circuit 21, a signal line driving circuit 22, and a capacitive electric potential line driving circuit 23. Although described below, in the AC driving mode, polarity (positive/negative) of the voltage applied to the liquid crystal element included in each pixel circuit PIX is reversed on the subfield basis.

In the element portion 10, M scanning lines 11 extending in the X-direction and N signal lines 12 extending in the Y-direction perpendicular to the X-direction are provided (where, M and N are any natural numbers equal to or larger than 2). A plurality of pixel circuits PIX are arranged at intersections between each scanning line 11 and each signal line 12 in a matrix shape of M rows by N columns. In the element portion 10, M capacitive electric potential lines 13 extending in the X-direction corresponding to each scanning line 11 are formed.

The control circuit 30 generates various signals and electric potentials for defining operations of the liquid crystal device 100 and supplies them to the driving circuit 20. Specifically, the control circuit 30 generates a first clock signal CLK1 and a first start pulse SP1 and supplies them to the scanning line driving circuit 21, and further generates an image signal DATA, a second start pulse SP2, a second clock signal CLK2, and a latch pulse LP and supplies them to the signal line driving circuit 22. In addition, the control circuit 30 generates a high-level potential voltage VcomH (1.25 V) and a low-level potential voltage VcomL (−1.25 V) and supplies them to the capacitive electric potential line driving circuit 23, and further generates a common electric potential LCCOM (0 V) and supplies it to the common electrode 42.

The first start pulse SP1 is a pulse having a certain period. The electric potential of the first start pulse SP1 is maintained at an active level (ON electric potential Von) for a certain time period from the leading end and maintained at an inactive level (OFF electric potential Voff) for other times. The period of the first start pulse SP1 corresponds with the length of the unit time (frame) for which the each pixel circuit PIX displays gradations of pixels. In the image signal DATA, gradation data for specifying gradations (white/black) of the liquid crystal elements of each pixel circuit PIX are arranged in ascending order in each row. In each row, the gradation data are arranged in ascending order in each column.

In addition, the control circuit 30 has a polarity signal generation circuit 31. The polarity signal generation circuit 31 generates a first polarity signal POL1 and a second polarity signal POL2 for specifying polarity of the voltage applied to the liquid crystal element 40 and supplies them to the capacitive electric potential line driving circuit 23. The polarity signals POL1 and POL2 are voltage signals, and the electric potential of each signal transition between the positive electric potential VH and the electric potential VL opposite to the polarity of VH. In this example, the electric potential of the polarity signal POL1 and the electric potential of the polarity signal POL2 are always opposite in polarity. That is, when the electric potential of the polarity signal POL1 has a high level VH, the electric potential of the polarity signal POL2 has a low level VL. When the electric potential of the polarity signal POL1 has a low level VL, the electric potential of the polarity signal POL2 has a high level VH.

The scanning line driving circuit 21 sequentially selects the M scanning lines 11 from the first row to the (M)th row (forward direction) for each predetermined time period (hereinafter, referred to as a write period). The scanning line driving circuit 21 is a shift register, for example, having (M+2) stages, and generates scanning signals G[0] to G[M+1] by transferring the first start pulse SP1 to the next stage at the timing assigned by the first clock signal CLK1 and performs the aforementioned selection by outputting the scanning signals G[1] to G[M] to each scanning line 11.

In addition, the scanning signals G[0] and G[M+1] are dummy signals that are not output to the scanning line 11 and supplied to the capacitive electric potential line driving circuit 23. Hereinafter, the time period for which only the scanning signal G[0] has an ON electric potential Von out of the scanning signals G[0] to G[M+1] is referred to as a "write period H[0]," and the time period for which only the scanning signal G[M+1] has an ON electric potential Von is referred to as a "write period H[M+1]".

The signal line driving circuit 22 controls the electric potential of the N signal lines 12 in synchronization with selection of each scanning line 11 in the scanning line driving circuit 21. Specifically, based on the image signal DATA, the second start pulse SP2, the second clock signal CLK2, and the latch pulse LP, the gradation signals S[1] to S[N] for specifying gradations (white/black) of the liquid crystal elements of each pixel circuit PIX of the (m)th row are supplied to each signal line 12 for the write period H[m]. The electric potential Vdata of the gradation signal S[n] is set to either one of the first electric potential VdataH (2.5 V) or the second electric potential VdataL (−2.5 V).

The capacitive electric potential line driving circuit 23 controls the electric potentials Vcom[1] to Vcom[M] of the M capacitive electric potential lines 13 (hereinafter, referred to as a "capacitive electric potential") in synchronization with selection of each scanning line 11 in the scanning line driving circuit 21. Specifically, based on the scanning signals G[0] to G[M+1] and the polarity signals POL1 and POL2, either one of the high-level electric potential VcomH and the low-level electric potential VcomL is selected for each capacitive electric potential line 13, and the selected electric potential is supplied to the corresponding capacitive electric potential line 13.

Figure 2:
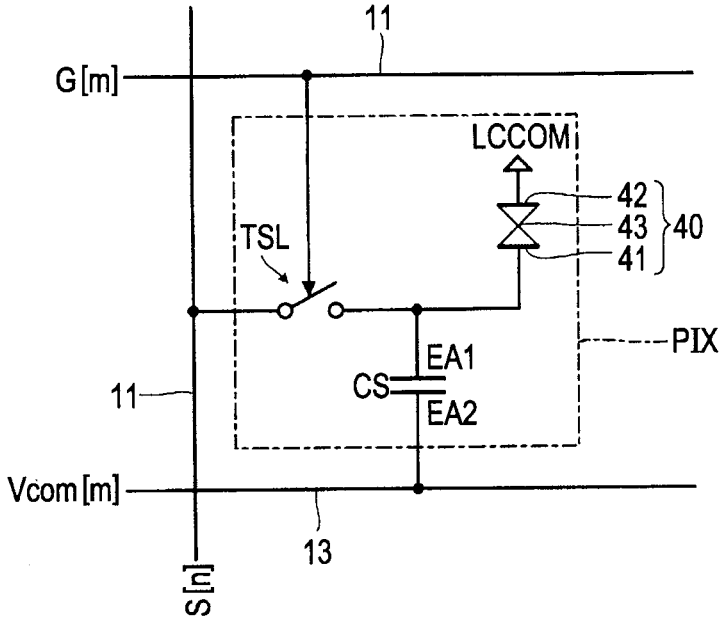
FIG. 2 is a circuit diagram illustrating a configuration of the pixel circuit within the liquid crystal device.

FIG. 2 is a circuit diagram illustrating a configuration of each pixel circuit PIX. In FIG. 2, a single pixel circuit PIX located at the (m)th row (m=1 to M) and the (n)th column (n=1 to N) is representatively illustrated. As shown in FIG. 2, the pixel circuit PIX includes a liquid crystal element 40, a selection switch TSL, and a retentive capacitor CS. The selection switch TSL is made of, for example, any conductive thin film transistor formed on the element substrate. The gate of the selection switch TSL in each pixel circuit PIX of the (m)th row is commonly connected to the scanning line 11 corresponding to the (m)th row.

The liquid crystal element 40 includes a pixel electrode 41, a common electrode (opposite electrode) 42, and a liquid crystal 43 between both electrodes 41 and 42. The pixel electrode 41 is independently formed in each pixel circuit PIX over the surface of the element substrate (not shown). The common electrode 42 is commonly formed across a plurality of pixel circuits PIX over the surface of the opposite substrate (not shown) opposite to the element substrate (refer to FIG. 1). The common electrode 42 is supplied with a fixed common electric potential LCCOM (0 V). The gradation (transmittance or reflectance) of the liquid crystal 43 between the pixel electrode 41 and the common electrode 42 varies in response to the voltage between both electrodes. The liquid crystal 43 is set to a VA (vertical alignment) type and operates in a normally black mode in which a lowest gradation (black)

is displayed when the voltage between the pixel electrode 41 and the common electrode 42 is 0 V.

The selection switch TSL of each pixel circuit PIX of the (n)th column is interposed between the pixel electrode 41 and the (n)th signal line 12 to control electric connection (connected/disconnected) therebetween. The retentive capacitor CS of each pixel circuit PIX of the (m)th row is interposed between the pixel electrode 41 and the capacitive electric potential line 13 corresponding to the (m)th row. Specifically, the retentive capacitor CS includes a dielectric material between the electrode EA1 connected to the pixel electrode 41 and the electrode EA2 connected to the capacitive electric potential line 13. The retentive capacitor CS has a function of storing the electric potential of the pixel electrode 41 (voltage applied to the liquid crystal element 40) and a function of the coupling capacitor for varying the voltage of the pixel electrode 41 in response to the capacitive electric potential Vcom [m].

Figure 3:
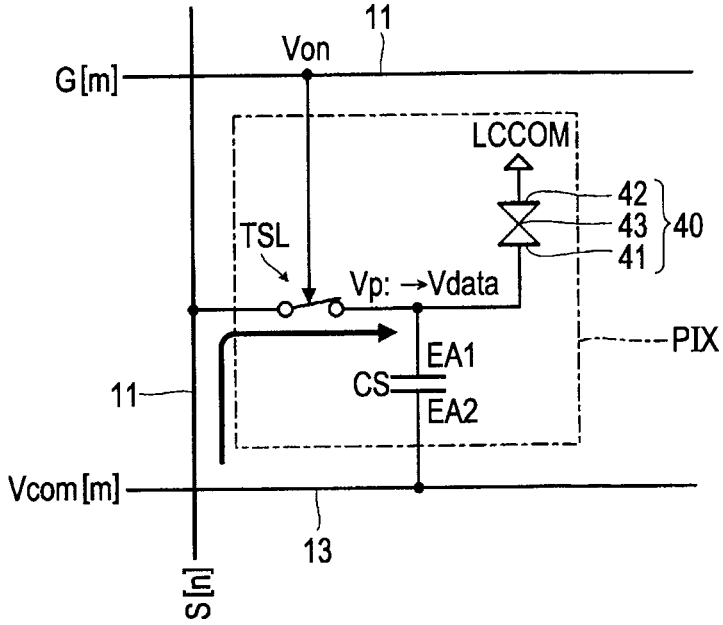
FIG. 3 illustrates a (write) operation of the pixel circuit.

Although described below in detail, the capacitive electric potential Vcom[m] transitions between the positive high-level electric potential VcomH and the low-level electric potential VcomL opposite to the polarity of the high-level electric potential VcomH, and the electric potential of the scanning signal G[m] supplied from the scanning line 11 transitions between the ON electric potential Von which turns on the selection switch TSL and the OFF electric potential Voff which turns off the selection switch TSL. As shown in FIG. 3, in the pixel circuit PIX located at the (m)th row and the (n) th column, during the time period when the electric potential of the scanning signal G[m] stays in Von (the write period H[m] of the (m)th row), the selection switch TSL is turned on, and the gradation signal S[n] is supplied to the pixel electrode 41. Therefore, the electric potential Vp of the pixel electrode 41 transitions to the electric potential Vdata of the gradation signal S[n].

Figure 4:
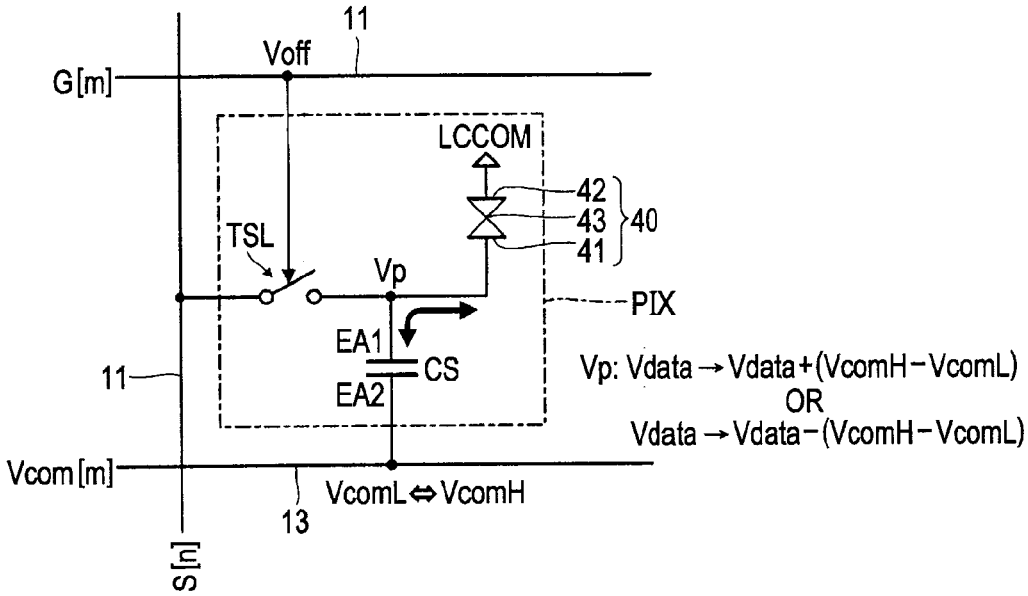
FIG. 4 illustrates a (polarity reversing) operation of the pixel circuit.

After the electric potential of the scanning signal G[m] transitions from Von to Voff, and the write period H[m] is terminated, the polarity of the capacitive electric potential Vcom[m] is reversed. As a result, as shown in FIG. 4, in each pixel circuit PIX located at the (m)th row, the electric potential of the electrode EA2 varies from VcomL to VcomH or from VcomH to VcomL. Accordingly, the electric potential of the electrode EA1 varies from Vdata and fluctuates between VcomH and VcomL. Therefore, the electric potential Vp of the pixel electrode 41 becomes Vdata+(VcomH−VcomL) or Vdata−(VcomH−VcomL), which is a voltage applied to the liquid crystal element 40. In practice, since electric charges are redistributed between the retentive capacitor CS, and the parasitic capacitor in the pixel electrode 41 and the liquid crystal capacitor, it could not be said that VcomH−VcomL becomes the fluctuation amount of the electric potential of the pixel electrode. According to the invention, the electric charge redistribution is simplified for the purpose of a convenient description, which is not intended to detract from the spirit of the invention.

Since VcomH−VcomL=1.25 V+1.25 V=5 V>0 V, the voltage applied to the liquid crystal element 40 is higher than VdataH when Vdata=VdataH and Vp=Vdata+(VcomH−VcomL), and the voltage applied to the liquid crystal element 40 is lower than VdataL when Vdata=VdataL and Vp=Vdata−(VcomH−VcomL). In other words, since it is assumed that the liquid crystal element 40 is driven in an AC mode, it is possible to widen the swing width (absolute value) of the voltage applied to the liquid crystal element 40 (set to VdataH+(VcomH−VcomL)) while narrowing the swing width (absolute value) of Vdata (set to VdataH) by appropriately driving the pixel circuit PIX. In other words, it is possible to increase the contrast while alleviating the burden on the driving circuit 20.

Figure 5:
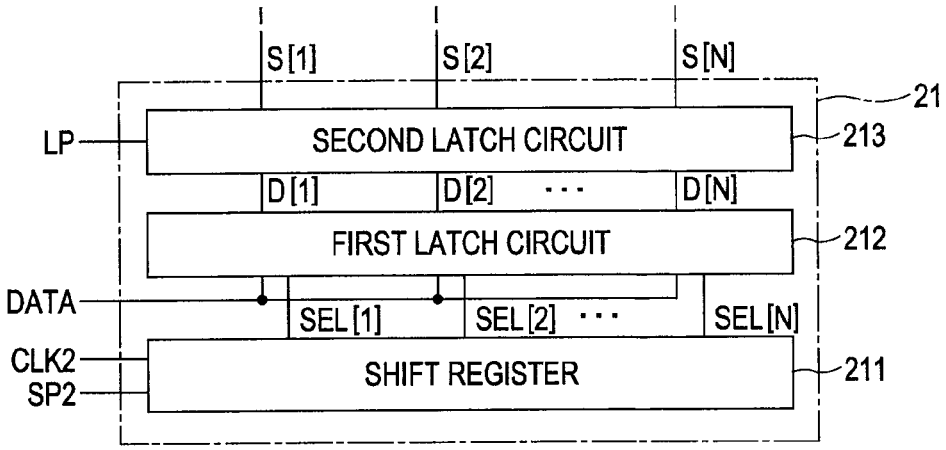
FIG. 5 is a block diagram illustrating a configuration of a signal line driving circuit within the liquid crystal device.

FIG. 5 is a block diagram illustrating a configuration of the signal line driving circuit 22. Referring to FIG. 5, the signal line driving circuit 22 includes an N-stage shift register 211, a first latch circuit 212, and a second latch circuit 213. The shift register 211 sequentially activates the selection signals SEL[1] to SEL[N] for N branches in the write period H[m] by transmitting the second start pulse SP2 to the next stage at the timing assigned by the second clock signal CLK2. The first latch circuit 212 receives and stores the image signal DATA supplied from the control circuit 30 when the selection signal SEL[n] is activated, and outputs the stored data as the gradation data D[n]. In other words, the gradation data D[1] to D[N] are point-sequentially output in parallel from the first latch circuit 212. The second latch circuit 213 receives and stores the gradation data D[1] to D[N] output from the first latch circuit 212 and concurrently (line-sequentially output) outputs them as gradation signals S[1] to S[N] at the timing assigned by the latch pulse LP (at the time point of the write period H[m]).

The gradation signal S[n] supplied to the (n)th signal line 12 in the write period H[m] is a voltage signal for specifying the gradation (black/white) for the liquid crystal element 40 in the pixel circuit PIX located in the (m)th row and the (n)th column. The electric potential of the gradation signal S[n] is set to any one of the electric potential for specifying a white gradation in the case of positive polarity (first electric potential VdataH), the electric potential for specifying a white gradation in the case of negative polarity (second electric potential VdataL), the electric potential for specifying a black gradation in the case of positive polarity (second electric potential VdataL), and the electric potential for specifying a black gradation in the case of negative polarity (specifically, first electric potential VdataH).

The capacitive electric potential line driving circuit 23 of FIG. 1 includes unit circuits R[1] to R[M] corresponding to the M capacitive electric potential lines 13, respectively. The unit circuit R[m] selects one of the high-level electric potential VcomH and the low-level electric potential VcomL based on the scanning signal G[m−1] and G[m+1], the polarity signal POL1, and the polarity signal POL2 and supplies the selected electric potential to the capacitive electric potential line 13 corresponding to the (m)th row.

Figure 6:
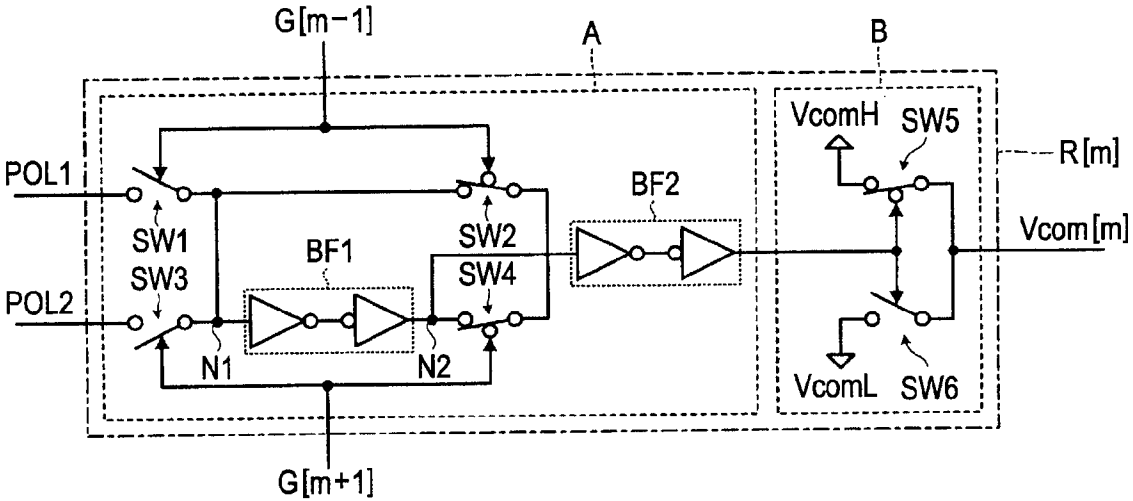
FIG. 6 is a block diagram illustrating a configuration of a unit circuit within the liquid crystal device.

FIG. 6 is a block diagram illustrating a unit circuit R[m]. Referring to FIG. 6, the unit circuit R[m] includes a sampling circuit A that samples one of the polarity signals POL1 and POL2 at the timing defined by the scanning signal G[m−1] and G[m+1], stores the electric potential obtained through the sampling, and outputs a signal of the stored electric potential, and a selection circuit B that selects one of the low-level electric potential VcomL and the high-level electric potential VcomH based on the output signal from the sampling circuit A.

The sampling circuit A includes a first switch SW1, a second switch SW2, a third switch SW3, a fourth switch SW4, buffer circuits BF1 and BF2, a first node N1, a second node N2, and an output terminal. One terminal of the first switch SW1 is supplied with the polarity signal POL1, and one terminal of the third switch SW3 is supplied with the polarity signal POL2. The first node N1 is connected to the other terminal of the first switch SW1, one terminal of the second switch SW2, the other terminal of the third switch SW3, and the input terminal of the buffer circuit BF1. The second node N2 is connected to one terminal of the fourth switch SW4, the output terminal of the buffer circuit BF1, and the input terminal of the buffer circuit BF2. The other terminal of the second switch SW2 is connected to the other terminal of the fourth switch SW4. The output terminal of the buffer circuit BF2 is connected to the output terminal of the sampling circuit A.

In the sampling circuit A of the unit circuit R[m], the scanning signal G[m−1] is supplied to the control terminals of the first and second switches SW1 and SW2, and the scanning signal G[m+1] is supplied to the control terminals of the third and fourth switches SW3 and SW4. The first switch SW1 and the second switch SW2 are exclusively turned on, and the third switch SW3 and the fourth switch SW4 are exclusively turned on. Specifically, when the scanning signal G[m−1] has an ON electric potential Von, the first switch SW1 is turned on, and the second switch SW2 is turned off. When the scanning signal G[m−1] has the OFF electric potential Voff, the first switch SW1 is turned off, and the second switch SW2 is turned on. When the scanning signal G[m+1] has the ON electric potential Von, the third switch SW3 is turned on, and the fourth switch SW4 is turned off. When the scanning signal G[m+1] has the OFF electric potential Voff, the third switch SW3 is turned off, and the fourth switch SW4 is turned on.

The selection circuit B includes a fifth switch SW5, a sixth switch SW6, an input terminal, and an output terminal. One terminal of the fifth switch SW5 is supplied with the high-level electric potential VcomH, and one terminal of the sixth switch SW6 is supplied with the low-level electric potential VcomL. The output terminal of the selection circuit B is connected to the other terminal of the fifth switch SW5 and the other terminal of the sixth switch SW6. The input terminal of the selection circuit B is connected to the output terminal of the sampling circuit A. When the electric potential of the signal input from the selection circuit B has a level VL, the fifth switch SW5 is turned on, and the sixth switch SW6 is turned off. When the electric potential of the signal input from the selection circuit B has a level VH, the fifth switch SW5 is turned off, and the sixth switch SW6 is turned on.

Here, operations of the unit circuit R[m] will be described by assuming that the electric potential of the polarity signal POL1 has a level VH (the electric potential of the polarity signal POL2 has a level VL).

Figure 7:
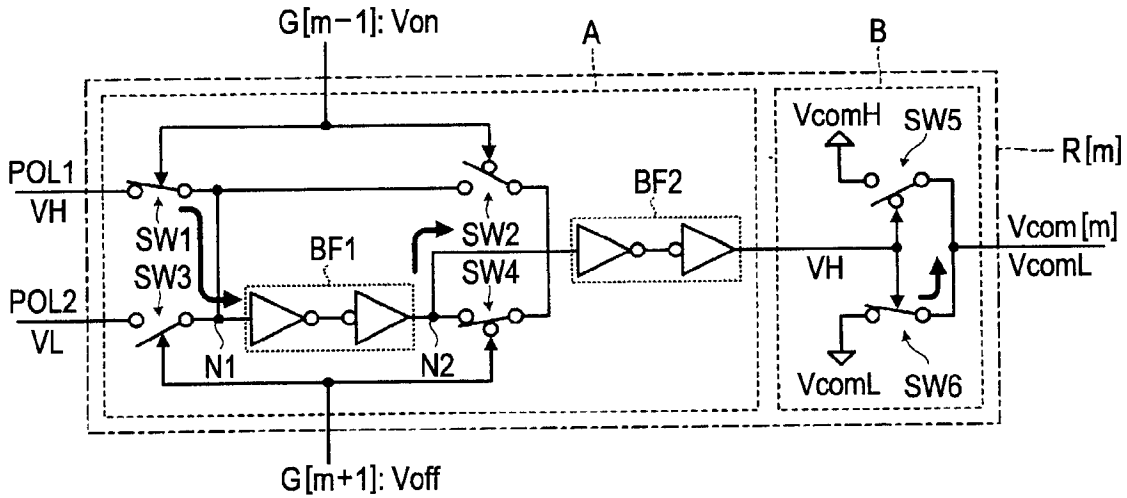
FIG. 7 illustrates operations of the unit circuit (when the (m−1)th row is selected).

Since the scanning signal G[m−1] has the ON electric potential Von, and the scanning signal G[m+1] has the OFF electric potential Voff as the scanning line 11 corresponding to the (m−1)th row is selected, the first switch SW1 and the fourth switch SW4 are turned on, and the second switch SW2 and the third switch SW3 are turned off in the sampling circuit A of the unit circuit R[m] as shown in FIG. 7. Therefore, polarity signal POL1 is supplied to the buffer circuit BF1 through the first switch SW1 and the node N1. The buffer circuit BF1 stores the electric potential of the supplied signal and outputs the stored electric potential. The electric potential output from the buffer circuit BF1 is supplied to the selection circuit B of the unit circuit R[m] through the buffer circuit BF2.

Here, since the electric potential of the polarity signal POL1 has a level VH, in the unit circuit R[m], the electric potential supplied from the sampling circuit A to the selection circuit B has a level VH. Therefore, in the selection circuit B, the fifth switch SW5 is turned off, and the sixth switch SW6 is turned on. Accordingly, the low-level electric potential VcomL is output from the output terminal of the selection circuit B. That is, the low-level electric potential VcomL is output to the capacitive electric potential line 13 corresponding to the (m)th row as the capacitive electric potential Vcom[m].

Figure 8:
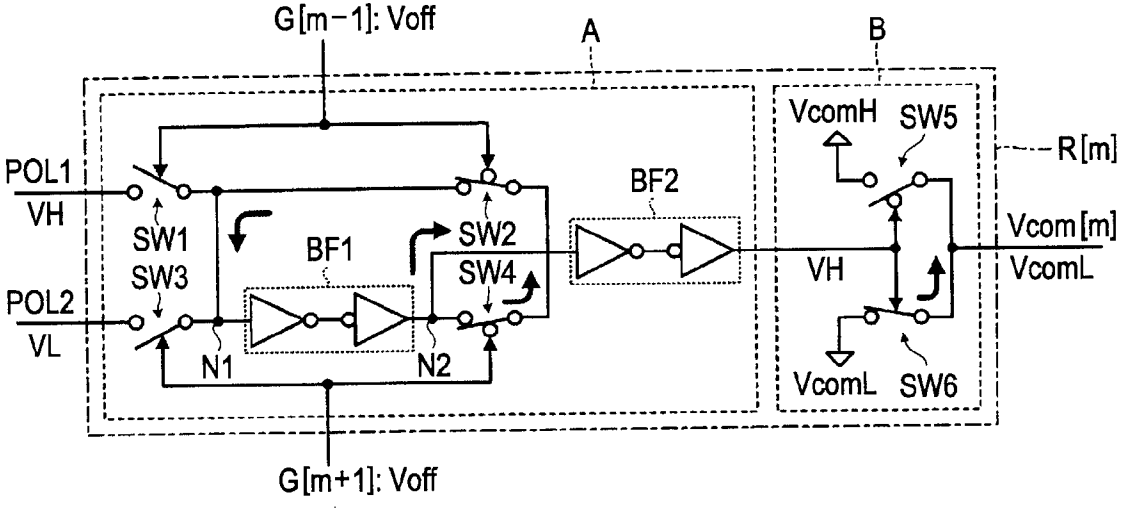
FIG. 8 illustrates operations of the unit circuit (when the (m)th row is selected).

Next, since the scanning signals G[m−1] and G[m+1] have the OFF electric potential Voff as the scanning line 11 corresponding to the (m)th row is selected, in the sampling circuit A of the unit circuit R[m], the second switch SW2 and the fourth switch SW4 are turned on, and the first switch SW1 and the third switch SW3 are turned off as shown in FIG. 8. Therefore, the electric potential VH stored in the buffer circuit BF1 is supplied to the selection circuit B of the unit circuit R[m] through the buffer circuit BF2. Accordingly, the low-level electric potential VcomL is output as Vcom[m] to the capacitive electric potential line 13 corresponding to the (m)th row.

Figure 9:
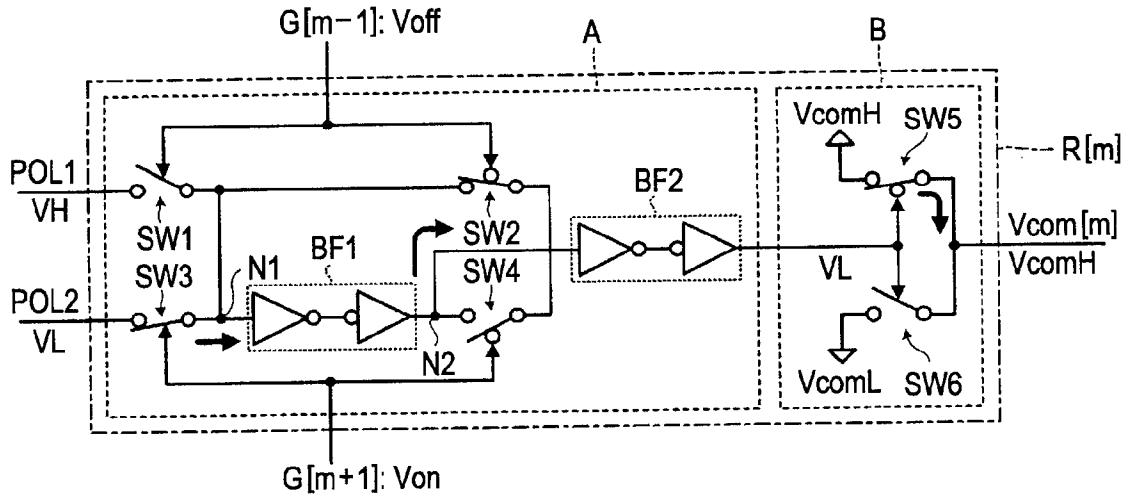
FIG. 9 illustrates operations of the unit circuit (when the (m+1)th row is selected).

Next, since the scanning signal G[m−1] has the OFF electric potential Voff, and the scanning signal G[m+1] has the ON electric potential Von as the scanning line 11 corresponding to the (m+1)th row is selected, in the sampling circuit A of the unit circuit R[m], the second switch SW2 and the third switch SW3 are turned on, and the first switch SW1 and the fourth switch SW4 are turned off as shown in FIG. 9. Therefore, the polarity signal POL2 is supplied to the buffer circuit BF1 through the third switch SW3 and the node N1. The buffer circuit BF1 stores the electric potential of the supplied signal and output the stored electric potential. The electric potential output from the buffer circuit BF1 is supplied to the selection circuit B of the unit circuit R[m] through the buffer circuit BF2.

Here, since the electric potential of the second polarity signal POL1 has a level VL, in the unit circuit R[m], the electric potential supplied from the sampling circuit A to the selection circuit B has a level VL. Therefore, in the selection circuit B, the fifth switch SW5 is turned on, and the sixth switch SW6 is turned off. Accordingly, the high-level electric potential VcomH is output from the output terminal of the selection circuit B. That is, the high-level electric potential VcomH is output as the capacitive electric potential Vcom[m] to the capacitive electric potential line 13 corresponding to the (m)th row.

Figure 10:
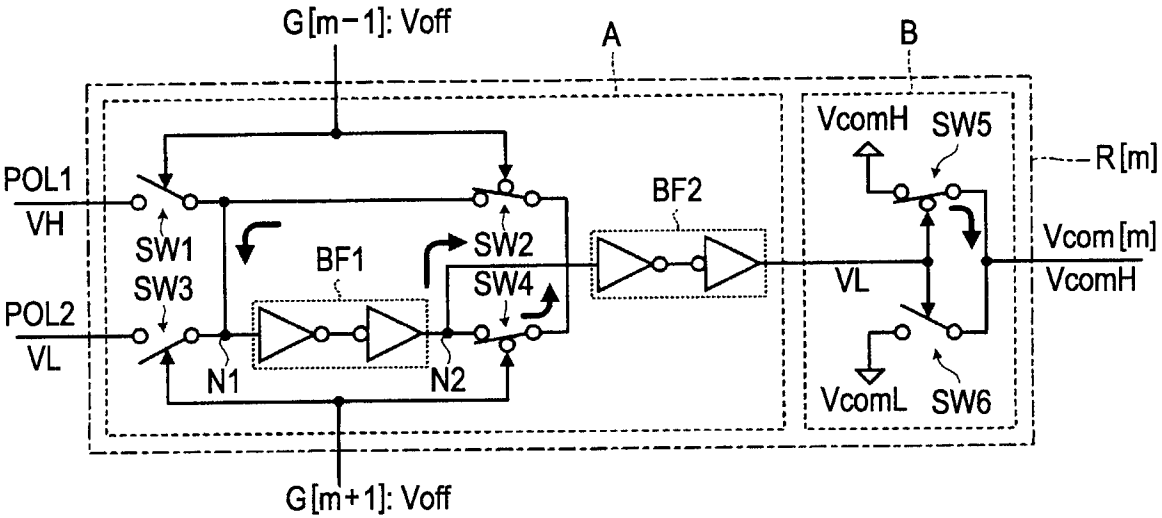
FIG. 10 illustrates operations of the unit circuit (when the row next to the (m+1)th row is selected).

Next, since the scanning signals G[m−1] and G[m+1] have the OFF electric potential Voff as the scanning line 11 corresponding to the row next to the (m+1)th row is selected, in the sampling circuit A of the unit circuit R[m], the second switch SW2 and the fourth switch SW4 are turned on, and the first switch SW1 and the third switch SW3 are turned off as shown in FIG. 10. Therefore, the electric potential VL stored in the buffer circuit BF1 is supplied to the selection circuit B of the unit circuit R[m] through the buffer circuit BF2. Accordingly, the high-level electric potential VcomH is output as the capacitive electric potential Vcom[m] to the capacitive electric potential line 13 corresponding to the (m)th row.

In this manner, when the electric potential of the polarity signal POL1 has a level VH (the electric potential of the polarity signal POL2 has a level VL), Vcom[m] becomes the low-level electric potential VcomL from the start of the write period H[m−1] to the start of the write period H[m+1], and Vcom[m] becomes the high-level electric potential VcomH from the start of the write period H[m+1] to the start of the next write period H[m−1]. On the contrary, when the electric potential of the polarity signal POL1 has a level VL (the electric potential of the polarity signal POL2 has a level VH), Vcom[m] becomes the high-level electric potential VcomH from the start of the write period H[m−1] to the start of the write period H[m+1], and Vcom[m] becomes the low-level electric potential VcomL from the start of the write period H[m+1] to the start of the next write period H[m−1]. Therefore, the unit circuit R[m] has the input/output characteristics as shown in FIG. 11.

As understood from the aforementioned description, the unit circuit R[m] selects one of the low-level electric potential VcomL and the high-level electric potential VcomH as the capacitive electric potential Vcom[m] based on the polarity signal POL1 in the write period H[m−1], stores the immediately preceding capacitive electric potential Vcom[m] in the write period H[m], and selects one of the low-level electric potential VcomL and the high-level electric potential VcomH as the capacitive electric potential Vcom[m] based on the polarity signal POL2 in the write period H[m+1].

Figure 12:
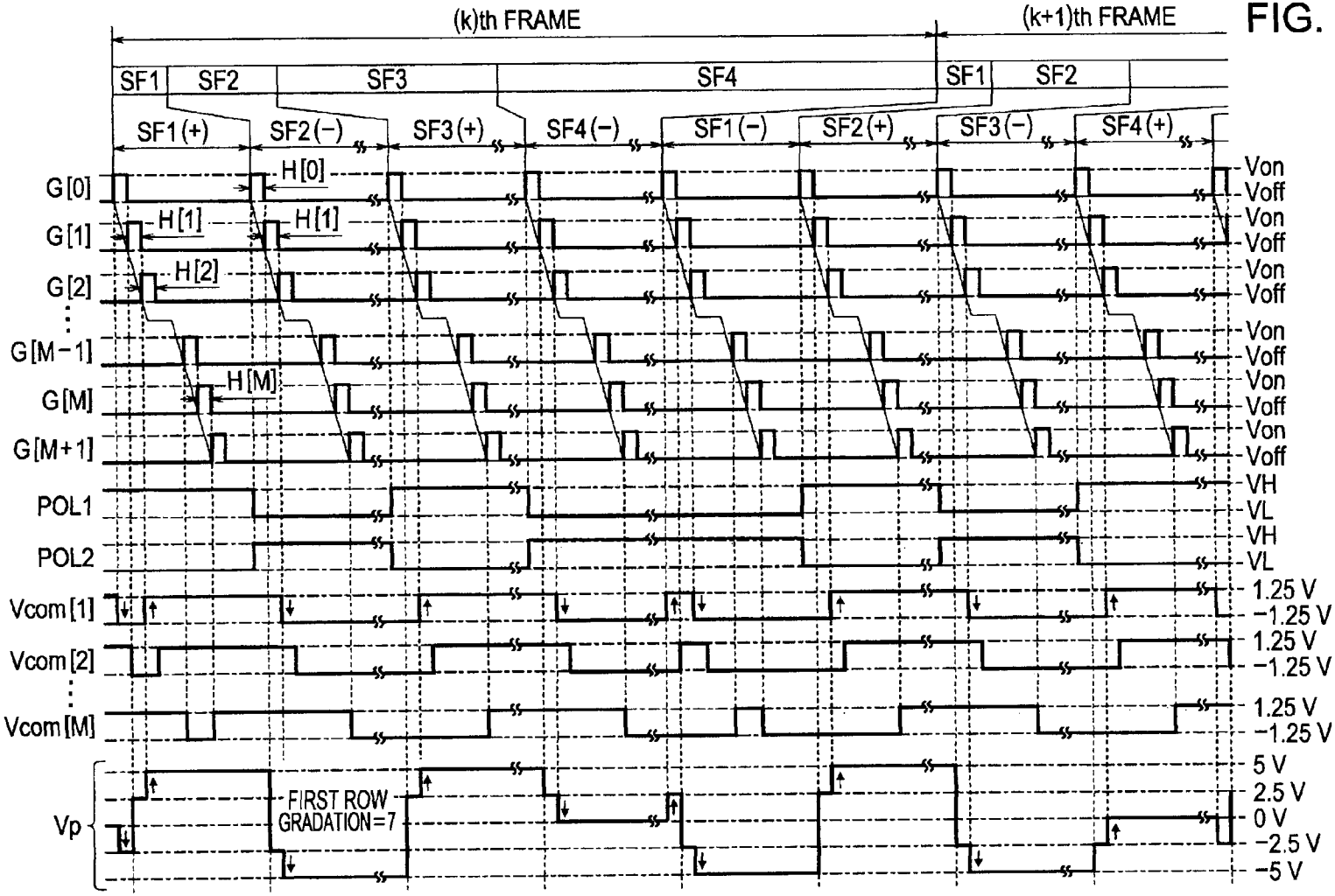
FIG. 12 is a timing chart illustrating fluctuation of the voltages in each part of the liquid crystal device.

FIG. 12 is a timing chart illustrating fluctuation of the electric potential of each part of the liquid crystal device 100. Referring to FIG. 12, the subfield driving is employed to drive each pixel circuit PIX using the driving circuit 20 of FIG. 1. Specifically, the driving circuit 20 structures each frame with four subfields SF (subfield period) having different lengths for each pixel circuit PIX and applies any one of three kinds of voltages, which will be described below, to the liquid crystal element 40 in each subfield SF of the corresponding frame in each frame of the corresponding pixel circuit PIX.

Focusing on a single pixel circuit PIX of the (m)th row, in each of the subfields SF1, SF2, SF3, and SF4, any one of three kinds of voltages is applied to the liquid crystal element 40 from the end of the write period H[m] to the end of the subfield SF. The three kinds of the voltages include a positive voltage (5 V) for setting the gradation of the liquid crystal element 40 to the white in the positive subfield SF described below, a negative voltage (−5 V) for setting the gradation of the liquid crystal element 40 to the white in the negative subfield SF described below, and a zero voltage (0 V) for setting the gradation of the liquid crystal element 40 to the black.

The driving circuit 20 swings the electric potential of the pixel electrode 41 of the liquid crystal element 40 by reversing the polarity of the electric potential of the capacitive electric potential line 13 as the write period H[m] is terminated in each subfield SF of the corresponding pixel circuit PIX for each pixel circuit PIX of the (m)th row based on the polarity signals POL1 and POL2. Hereinafter, the subfield SF in which the electric potential of the pixel electrode 41 is raised up through the reversing is referred to as a "positive subfield SF", and the subfield SF in which the electric potential of the pixel electrode 41 falls down through the reversing is referred to as a "negative subfield SF".

When the positive subfield SF is denoted by "+," the negative subfield SF is denoted by "−," and the boundary of the frame is denoted by "|," the subfields SF1 to SF4 in the liquid crystal device 100 are sequenced in the order of "...−+|+−+−|−+−+|+− ...". That is, while the polarity (positive/negative) of the voltage applied to the liquid crystal element 40 is reversed in every subfield SF in principle, it is not reversed in the boundary of the frame.

The time length of each subfield SF within the frame is set to a binary weighting relationship (SF1:SF2:SF3:SF4=1:2:4:8). That is, each subfield SF is weighted. In addition, each liquid crystal element 40 can display any one of 16 gradations including the (0)th gradation (darkest black) to the (15)th gradation (brightest black) in each frame. A relationship between each of the 16 gradations and the voltage pattern applied to the liquid crystal element 40 is shown in FIG. 13. FIG. 13 illustrates the voltage application pattern in the (k)th frame and the voltage application pattern in the (k+1)th frame for each of the 16 gradations including the (0)th gradation to the (15)th gradation when the corresponding gradations are sequentially displayed on the same liquid crystal element 40.

In the write period H[m], the selection switches TSL of each pixel circuit PIX of the (m)th row are turned on as shown in FIG. 3, and the selection switches TSL of each pixel circuit PIX of other rows are turned off as shown in FIG. 4. Meanwhile, the N signal lines 12 are supplied with the gradation signals S[1] to S[N] for specifying each of the gradations (white/black) of the liquid crystal elements 40 of the N pixel circuits PIX of the (m)th row in the write period H[m]. Therefore, in the write period H[m], the electric potential Vdata of the gradation signal S[n] is written to the pixel electrode 41 of the pixel circuit PIX located in the (m)th row and the (n)th column.

As described above, the electric potential Vdata of the gradation signal S[n] supplied to the signal line 12 of the (n)th column is the first electric potential VdataH or the second electric potential VdataL. The first electric potential VdataH assigns the white gradation in the positive subfield SF and assigns the black gradation in the negative subfield SF. The second electric potential VdataL assigns the white gradation in the negative subfield SF and assigns the black gradation in the positive subfield SF.

In principle, the polarity in the electric potentials of the polarity signals POL1 and POL2 is reversed at the start of the write period H[0]. For example, the electric potential of the polarity signal POL1 transitions from VH to VL at the start of the write period H[0] in the subfield SF2 of the (k)th frame, and transitions from VL to VH at the start of the write period H[0] in the subfield SF3 of the (k)th frame. However, in the first subfield SF of each frame, the polarity is not reversed. For example, the polarity signal POL1 is maintained in VL at the start of the write period H[0] in the subfield SF1 of the (k+1)th frame.

Hereinafter, operations of the liquid crystal device 100 based on the polarity signals POL1 and POL2 having the aforementioned waveforms will be described focusing on the pixel circuits PIX located in the first row and the (n)th column. In this description, in order to facilitate understanding the fact that the remnant DC component can be avoided, it is assumed that the gradation signal S[n] for displaying the same gradation (specifically, the 7th gradation) is continuously supplied to the pixel circuit PIX located in the first row and the (n)th column. As apparent from FIG. 13, the electric potential Vdata of the gradation signal S[n] for displaying the 7th gradation becomes the first electric potential VdataH (2.5 V) in the subfields SF1, SF3, and SF4 and becomes the second electric potential VdataL (−2.5 V) in the subfield SF2.

1. (k)th Frame 1-1. Subfield SF1

1-1-1. Write Period H[1]

The (k)th frame starts from the subfield SF1, and the subfield SF1 starts from the write period H[1]. In this write period H[1], the electric potential Vdata of the gradation signal S[n] is written to the pixel electrode 41. Since the electric potential Vdata of the gradation signal S[n] is set to VdataH, the electric potential Vp of the pixel electrode 41 is maintained in VdataH (2.5 V) in the write period H[1].

In addition, since, in the write period H[1], the electric potential in the scanning signals G[0] and G[2] is at the OFF electric potential Voff, in the unit circuit R[1], the second switch SW2 and the fourth switch SW4 are turned on, and the first switch SW1 and the third switch SW3 are turned off as shown in FIG. 10. Therefore, in the unit circuit R[1], the electric potential stored in the buffer circuit BF1 is supplied from the sampling circuit A to the selection circuit B. Although described in detail below, the buffer circuit BF1 stores VH at this moment. Therefore, in the selection circuit B, the fifth switch SW5 is turned off, and the sixth switch SW6 is turned on as shown in FIG. 8. Therefore, the capacitive electric potential Vcom[1] is maintained in the low-level electric potential VcomL (−1.25 V).

1-1-2. Write Period H[2]

In the subsequent write period H[2], the selection switch TSL is turned off as shown in FIG. 4. In addition, in the write period H[2], since the electric potential of the scanning signal G[0] is at the OFF electric potential Voff, and the electric potential of the scanning signal G[2] is the ON electric potential Von, in the unit circuit R[1], the second switch SW2 and the third switch SW3 are turned on, and the first switch SW1 and the fourth switch SW4 are turned off as shown in FIG. 9. Therefore, in the unit circuit R[1], the electric potential VL of the polarity signal POL2 is stored in the buffer circuit BF1 and supplied from the sampling circuit A to the selection circuit B. In the selection circuit B, since the fifth switch SW5 is turned on, and the sixth switch SW6 is turned off as shown in FIG. 9, the capacitive electric potential Vcom[1] is maintained in the high-level electric potential VcomH (1.25 V).

In this manner, at the start of the write period H[2], the capacitive electric potential Vcom[1] transitions from the low-level electric potential VcomL to the high-level electric potential VcomH. As a result, as shown in FIG. 4, the electric potential Vp of the pixel electrode 41 transitions from VdataH to VdataH+(VcomH−VcomL). Specifically, as shown in FIG. 12, the electric potential transitions from 2.5 V to 2.5+(1.25 V+1.25 V)=5 V. Therefore, in the write period H[2], the electric potential Vp of the pixel electrode 41 is maintained in 5 V.

1-1-3. Period from the Start of the Write Period H[3] to the Start of the Write Period H[0]

In the period from the start of the subsequent write period H[3] to the start of the write period H[0], the selection switch TSL is turned off as shown in FIG. 4. In this period, since the electric potentials of the scanning signals G[0] and G[2] are at the OFF electric potential Voff, in the unit circuit R[1], the second switch SW2 and the fourth switch SW4 are turned on, and the first switch SW1 and the third switch SW3 are turned off as shown in FIG. 10. Therefore, in the unit circuit R[1], the electric potential VL stored in the buffer circuit BF1 is supplied from the sampling circuit A to the selection circuit B. In this selection circuit B, since the fifth switch SW5 is turned on, and the sixth switch SW6 is turned off as shown in FIG. 10, the capacitive electric potential Vcom[1] is maintained in the high-level electric potential VcomH (1.25 V). Therefore, in this period, the electric potential Vp of the pixel electrode 41 is maintained in 5 V.

1-1-4. Write Period H[0]

In the subsequent write period H[0], the selection switch TSL is turned off as shown in FIG. 4. At the start of the write period H[0], the electric potential of the polarity signal POL1 transitions from VH to VL. In addition, in this period, since the electric potential of the scanning signal G[0] is at the ON electric potential Von, and the electric potential of the scanning signal G[2] is at the OFF electric potential Voff, in the unit circuit R[1], the first switch SW1 and the fourth switch SW4 are turned on, and the second switch SW2 and the third switch SW3 are turned off as shown in FIG. 7. Therefore, in the unit circuit R[1], the electric potential VL of the polarity signal POL1 is stored in the buffer circuit BF1, and VL is supplied from the sampling circuit A to the selection circuit B. In this selection circuit B, since the fifth switch SW5 is turned on, and the sixth switch SW6 is turned off as shown in FIG. 9, the capacitive electric potential Vcom[1] is maintained in the high-level electric potential VcomH (1.25 V). Therefore, in the write period H[0], the electric potential Vp of the pixel electrode 41 is maintained in 5 V.

1-2. Subfield SF2

1-2-1. Write Period H[1]

The subsequent subfield SF2 also starts from the write period H[1]. In the write period H[1], the electric potential Vdata of the gradation signal S[n] is written to the pixel electrode 41. Since the electric potential Vdata of the gradation signal S[n] is at VdataL, the electric potential Vp of the pixel electrode 41 is maintained in VdataL (−2.5 V) during the write period H[1].

In addition, in this write period H[1], since the electric potential of the scanning signal G[0] and G[2] is at the OFF electric potential Voff, in unit circuit R[1], the electric potential VL maintained in the buffer circuit BF1 is supplied from the sampling circuit A to the selection circuit B so that, in the selection circuit B, the fifth switch SW5 is turned on, and the sixth switch SW6 is turned off as shown in FIG. 10. Therefore, the capacitive electric potential Vcom[1] is maintained in the high-level electric potential VcomH (1.25 V).

1-2-2. Write Period H[2]

In the subsequent write period H[2], the selection switch TSL is turned off as shown in FIG. 4. In this write period H[2], since the electric potential of the scanning signal G[0] is at the OFF electric potential Voff, and the electric potential of the scanning signal G[2] is at the ON electric potential Von, in the unit circuit R[1], the second switch SW2 and the third switch SW3 are turned on, and the first switch SW1 and the fourth switch SW4 are turned off as shown in FIG. 9. Therefore, in the unit circuit R[1], the electric potential VH of the polarity signal POL2 is stored in the buffer circuit BF1, and VH is supplied from the sampling circuit A to the selection circuit B. In the selection circuit B, since the fifth switch SW5 is turned off, and the sixth switch SW6 is turned on as shown in FIG. 8, the capacitive electric potential Vcom[1] is maintained in the low-level electric potential VcomL (−1.25 V).

In this manner, at the start of the write period H[2], the capacitive electric potential Vcom[1] transitions from the high-level electric potential VcomH to the low-level electric potential VcomL. As a result, as shown in FIG. 4, the electric potential Vp of the pixel electrode 41 transitions from VdataL to VdataL−(VcomH−VcomL). Specifically, as shown in FIG. 12, the electric potential Vp transitions from −2.5 V to −2.5 V−(1.25 V+1.25 V)=−5 V. Therefore, in the write period H[2], the electric potential Vp of the pixel electrode 41 is maintained in −5 V.

1-2-3. Period from the Start of the Write Period H[3] to the Start of the Write Period H[0]

In the subsequent period from the start of the write period H[3] to the start of the write period H[0], the same operation as that performed in the period from the start of the write period H[3] of the subfield SF1 of the (k)th frame to the start of the write period H[0] are made. However, since the electric potential maintained in the buffer circuit BF1 of the unit circuit R[1] is at VH, the capacitive electric potential Vcom [1] is maintained in the low-level electric potential VcomL (−1.25 V). Therefore, in this period, the electric potential Vp of the pixel electrode 41 is maintained in −5 V.

1-2-4. Write Period H[0]

In the subsequent write period H[0], the same operation as that of the write period H[0] of the subfield SF1 of the (k)th frame is made. However, at the start of the write period H[0], the electric potential of the polarity signal POL1 transitions from VL to VH. Therefore, VH is stored in the buffer circuit BF1 of the unit circuit R[1], and the capacitive electric potential Vcom[1] is maintained in the low-level electric potential VcomL (−1.25 V). Therefore, in this period, the electric potential Vp of the pixel electrode 41 is maintained in −5 V.

1-3. Subfield SF3

In the subsequent subfield SF3, the same operation as that of the subfield SF1 of the (k)th frame is made. In other words, the electric potential Vp of the pixel electrode 41 is maintained in VdataH (2.5 V) during the write period H[1] and maintained in VdataH+(VcomH−VcomL)=5 V during the period from the start of the write period H[2] to the end of the write period H[0]. The capacitive electric potential Vcom[1] is maintained in the low-level electric potential VcomL (−1.25 V) during the write period H[1] and maintained in the high-level electric potential VcomH (1.25 V) during the period from the start of the write period H[2] to the end of the write period H[0].

1-4. Subfield SF4

1-4-1. Period from the Start of the Write Period H[1] to the Start of the Write Period H[0]

The subsequent subfield SF4 also starts from the write period H[1]. During the period from the start of the write period H[1] to the start of the write period H[0], the same operation as that of the period from the start of the write period H[1] of the subfield SF2 of the (k)th frame to the start of the write period H[0] is made. However, since the electric potential Vdata of the gradation signal S[n] in the write period H[1] of the subfield SF4 of the (k)th frame is at VdataH, the electric potential Vp of the pixel electrode 41 is maintained in VdataH (2.5 V) during the write period H[1] in the subfield SF4 and maintained in VdataH-(VcomH−VcomL)=0 V during the period from the start of the write period H[2] to the start of the write period H[0]. Meanwhile, the capacitive electric potential Vcom[1] is maintained in the high-level electric potential VcomH during the write period H[1] in the subfield SF4, and maintained in the low-level electric potential VcomL during the period from the start of the write period H[2] to the start of the write period H[0].

1-4-2. Write Period H[0]

In the subsequent write period H[0], the same operation as that of the write period H[0] of the subfield SF2 of the (k)th frame is made. However, at the start of the write period H[0] of the subfield SF2 of the (k)th frame, the electric potential of the polarity signal POL1 transitions from VL to VH. However, at the start of the write period H[0] of the subfield SF4 of the (k)th frame, such a transition is not made. That is, the electric potential of the polarity signal POL1 is maintained in VL across the subfield SF4 of the (k)th frame. Therefore, during the write period H[0] of the subfield SF4, the buffer circuit BF1 of the unit circuit R[1] stores VL, and the capacitive electric potential Vcom[1] is maintained in the high-level electric potential VcomH. That is, at the start of the write period H[0], the capacitive electric potential Vcom[1] transitions from the low-level electric potential VcomL to the high-level electric potential VcomH.

2. (k+1)th Frame

In the subsequent (k+1)th frame, the same operation as that of the (k)th frame is made. However, since the polarity of the electric potentials of the polarity signal POL1 and the first polarity signal POL2 is reversed three times in each frame, the polarity of the corresponding subfield SF is reversed between the (k)th frame and the (k+1)th frame. For example, while the subfield SF of the (k)th frame is positive, the subfield SF of the (k+1)th frame is negative. For this reason, the electric potential Vp of the pixel electrode 41 and the capacitive electric potential Vcom[1] in the (k+1)th frame have polarity opposite to the electric potentials Vp of the pixel electrode 41 and the of the capacitive electric potential Vcom[1] of the (k)th frame, respectively. Therefore, the buffer circuit BF1 of the unit circuit R[1] stores VH during the write period H[0] of the subfield SF4 of the (k+1)th frame. This is the reason why the buffer circuit BF1 of unit circuit R[1] stores VH during the write period H[1] of the subfield SF1 of the (k)th frame.

While the pixel circuit PIX located in the first row and the (n)th column has been exemplified in the aforementioned description, the aforementioned operation may be similarly performed for the pixel circuit PIX located in the (m)th row and the (n)th column. Of course, the electric potential Vp of the pixel electrode 41 of the pixel circuit PIX located in the (m)th row and the (n)th column varies depending on the capacitive electric potential Vcom[m] generated by the unit circuit R[m] based on the scanning signal G[m−1] and the scanning signal G[m+1]. In addition, each frame for the pixel circuit PIX located in the (m)th row and the (n)th column starts from the write period H[m].

In this manner, the capacitive electric potential line driving circuit 23 of the liquid crystal device 100 performs a first process of supplying one of the low-level electric potential VcomL and high-level electric potential VcomH as the capacitive electric potential Vcom[m] to the capacitive electric potential line 13 corresponding to the (m)th row, in which, as the write period H[m] for the (m)th row in each subfield SF included in the frame is terminated, the polarity of the capacitive electric potential Vcom[m] is reversed, and the polarity of the capacitive electric potential Vcom[m] is reversed again at the start of the write period H[m−1] after the polarity of the capacitive electric potential Vcom[m] is reversed in the final subfield SF4 of the frame. Therefore, the liquid crystal device 100 has advantages illustrated in FIG. 13.

FIG. 13 shows comparison expressions between a time integral (absolute value) of the positive voltages and a time integral (absolute value) of the negative voltages applied to the corresponding liquid crystal element 40 for each of a total of 16 gradations including 0th to 15th gradations from the start of the (k)th frame to the end of the (k+1)th frame. Referring to FIG. 13, when the same gradations are successively displayed on the same liquid crystal element 40 in the liquid crystal device 100, the polarity of the voltages applied in the corresponding subfields SF having the same length is opposite between two neighboring frames. Therefore, in such frames, the time integral (absolute value) of the positive voltage is equal to the time integral (absolute value) of the negative voltage so that the DC component is removed. That is, the remnant DC component is avoided in the liquid crystal device 100.

On the other hand, focusing on a single frame, the DC component still remains in the liquid crystal device 100. However, in the liquid crystal device 100, the polarity of the capacitive electric potential is reversed in each subfield in principle as the write period is terminated. Therefore, even focusing on a single frame, the maximum value (absolute value) of the remnant DC component can be reduced. This is advantageous in suppressing the degradation of each liquid crystal element 40.

Figure 14:
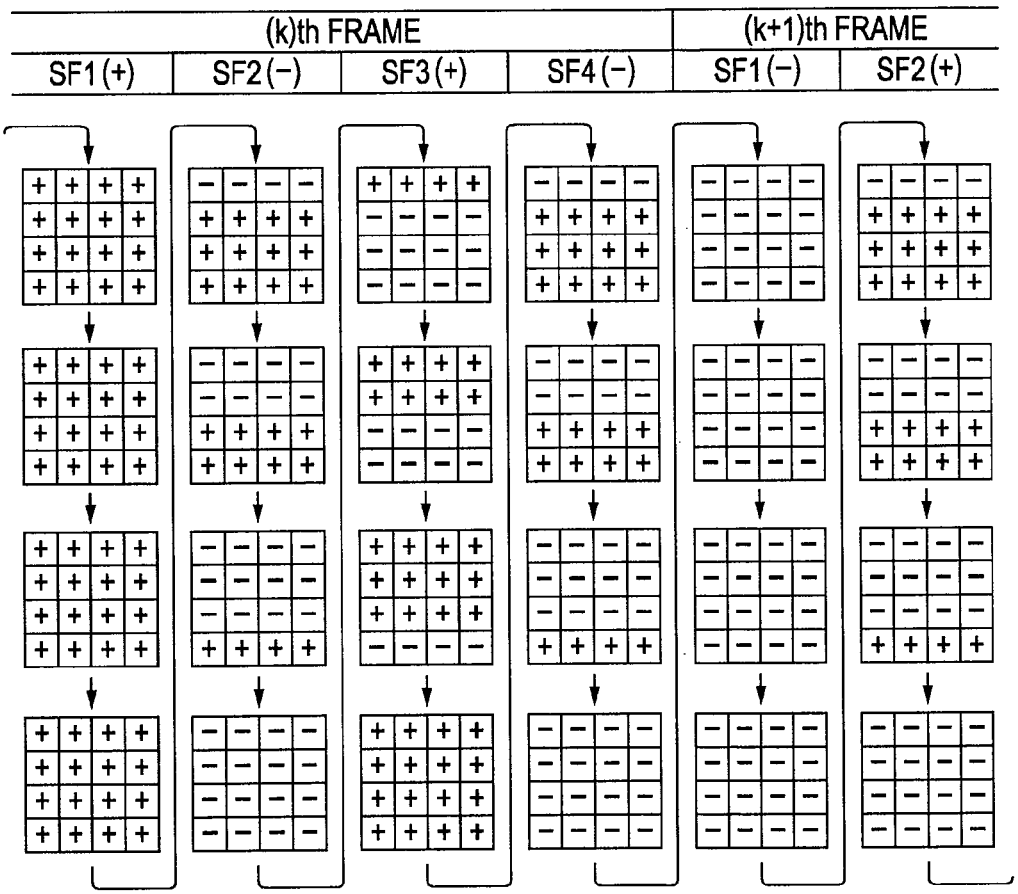
FIG. 14 is a conceptual diagram illustrating other advantages of the liquid crystal device.

FIG. 14 is a conceptual diagram illustrating another advantage of the liquid crystal device 100. FIG. 14 shows change of the polarity of the electric potential Vp in all of the pixel electrodes 41 of the liquid crystal device 100 for each write period. However, in FIG. 14, in order to avoid complicated illustration, the number of pixel electrodes 41 provided in the liquid crystal device 100 is set to 4 rows×4 columns=16. In the liquid crystal device 100, in principle, the polarity of the voltage applied to the liquid crystal element 40 is reversed in each subfield SF. Therefore, in each subfield SF, a portion (shown as the thick solid line in FIG. 14) in which the electric potential of the pixel electrode 41 is significantly different between the neighboring rows scans the display area in principle.

In this portion, an unexpected strong electric field may be generated in the column direction (the Y-direction in FIG. 1). That is, when this portion scans the display area, display quality such as contrast may be degraded. Therefore, it is preferable to reduce the frequency of scanning the display area using this portion. When the polarity of the voltage applied to the liquid crystal element 40 is necessarily reversed in each subfield SF, the scanning using the aforementioned portion is performed 4 times per single frame. However, since, in the liquid crystal device 100, the aforementioned reversing is not performed in the final subfield SF of each frame, the scanning using the aforementioned portion is performed 3 times per single frame as shown in FIG. 14. That is, according to an embodiment of the invention, it is possible to improve the image display quality.

2. Second Embodiment

Figure 15:
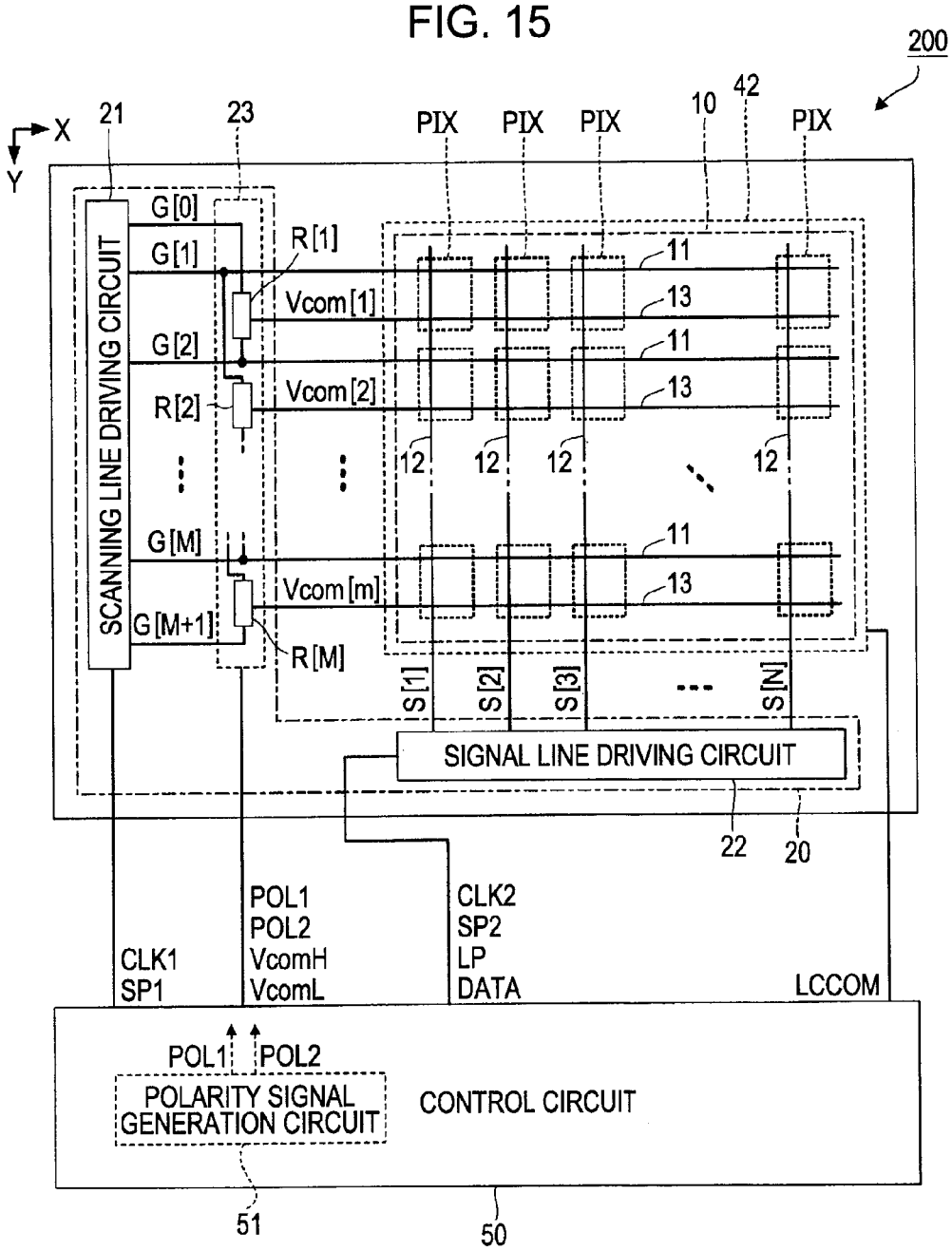
FIG. 15 is a block diagram illustrating a configuration of the liquid crystal device according to the second embodiment of the invention.

FIG. 15 is a block diagram illustrating a configuration of the liquid crystal device 200 according to the second embodiment of the invention. The liquid crystal device 200 is employed in various electronic apparatuses as a display body for displaying images and has the same configuration as that of the liquid crystal device 100 of FIG. 1. However, in the liquid crystal device 200, during the AC driving using the driving circuit 20, the (positive/negative) polarity of the voltage applied to each liquid crystal element 40 is reversed not on a subfield basis but on a frame basis. For this reason, the liquid crystal device 200 includes a control circuit 50 instead of the control circuit 30.

The control circuit 50 is different from the control circuit 30 in that the polarity signal generation circuit 51 is provided instead of the polarity signal generation circuit 31. Similar to the polarity signal generation circuit 31, the polarity signal generation circuit 51 generates the polarity signals POL1 and POL2 for specifying polarity of the voltage applied to the liquid crystal element 40 and supplies them to the capacitive electric potential line driving circuit 23. However, the polarity signals POL1 and POL2 generated by the polarity signal generation circuit 51 are different from the polarity signals POL1 and POL2 generated by the polarity signal generation circuit 31 in the timing for reversing the polarity of the electric potential.

Figure 16:
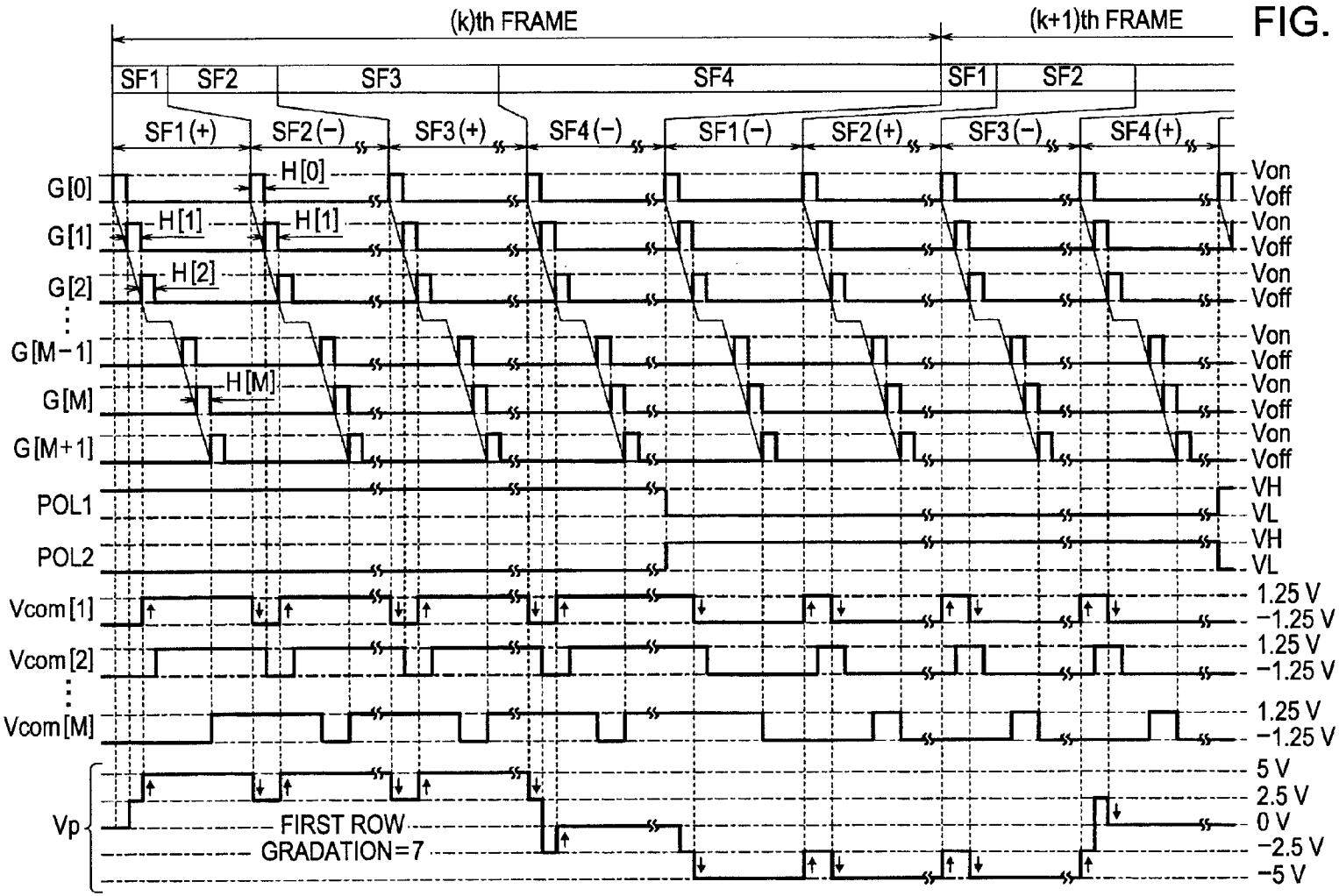
FIG. 16 is a timing chart illustrating fluctuation of voltages in each part of the liquid crystal device.

FIG. 16 is a timing chart illustrating fluctuation of the electric potential of each part of the liquid crystal device 200. Referring to FIG. 16, the driving circuit 20 reverses the (positive/negative) polarity of the voltage applied to the liquid crystal element 40 in each frame. That is, the polarity of the subfields SF1 to SF4 is sequenced in the order of " . . . −−|++++|−−−−|++ . . ." In order to provide such a sequence, each polarity of the electric potentials of the polarity signals POL1 and POL2 is reversed at the start of the initial write period H[0] of each frame. For example, the electric potential of the polarity signal POL1 transitions from VL to VH at the start of the initial write period H[0] of the (k)th frame, and transitions from VH to VL at the start of the initial write period H[0] of the (k+1)th frame.

Thereafter, the operation of the liquid crystal device 200 based on the polarity signals POL1 and POL2 having the aforementioned waveforms will be described focusing on the pixel circuit PIX located in the first row and the (n)th column. In this description, similar to the first embodiment, the gradation signal S[n] for displaying the 7th gradation is continuously supplied to the pixel circuit PIX located in the first row and the (n)th column. In addition, since the timing for writing the electric potential to the pixel electrode 41 of the pixel circuit PIX located in the first row and the (n)th column or the electric potential written thereto is similar to that of the liquid crystal device 100, a description thereof will be simplified.

1. (k)th Frame 1-1. Subfield SF1

1-1-1. Write Period H[1]

The (k)th frame starts from the subfield SF1, and the subfield SF1 starts from the write period H[1]. In this write period H[1], the electric potential Vp of the pixel electrode 41 is maintained in VdataH (2.5 V). On the other hand, since the electric potentials of the scanning signals G[0] and G[2] are at the OFF electric potential Voff in the write period H[1], in the unit circuit R[1], the electric potential stored in the buffer circuit BF1 is supplied from the sampling circuit A to the selection circuit B as shown in FIG. 10. Although described below in detail, VH is stored in the buffer circuit BF1 at this moment. Therefore, in the selection circuit B, the fifth switch SW5 is turned off, and the sixth switch SW6 is turned on as shown in FIG. 8. Therefore, the capacitive electric potential Vcom[1] is maintained in the low-level electric potential VcomL (−1.25 V).

1-1-2. Write Period H[2]

In the subsequent write period. H[2], the selection switch TSL is turned off as shown in FIG. 4. In this write period H[2], since the electric potential of the scanning signal G[0] is at the OFF electric potential Voff, and the electric potential of the scanning signal G[2] is at the ON electric potential Von, in the unit circuit R[1], the second switch SW2 and the third switch SW3 are turned on, and the first switch SW1 and the fourth switch SW4 are turned off as shown in FIG. 9. Therefore, in the unit circuit R[1], the electric potential VL of the polarity signal POL2 is stored in the buffer circuit BF1, and VL is supplied from the sampling circuit A to the selection circuit B. On the selection circuit B, since the fifth switch SW5 is turned on, and the sixth switch SW6 is turned off as shown in FIG. 9, the capacitive electric potential Vcom[1] is maintained in the high-level electric potential VcomH (1.25 V).

In this manner, at the start of the write period H[2], the capacitive electric potential Vcom[1] transitions from the low-level electric potential VcomL to the high-level electric potential VcomH. As a result, the electric potential Vp of the pixel electrode 41 transitions from VdataH to VdataH+(VcomH−VcomL) as shown in FIG. 4. Specifically, as shown in FIG. 16, the electric potential transitions from 2.5 V to 2.5 V+(1.25 V+1.25 V)=5 V. Therefore, during the write period H[2], the electric potential Vp of the pixel electrode 41 is maintained in 5V.

1-1-3. Period from the Start of Write Period H[3] to the Start of the Write Period H[0]

During the subsequent period from the start of write period H[3] to the start of the write period H[0], the selection switch TSL is turned off as shown in FIG. 4. In this period, since the electric potentials of the scanning signals G[0] and G[2] are at the OFF electric potential Voff, in the unit circuit R[1], the second switch SW2 and the fourth switch SW4 are turned on, and the first switch SW1 and the third switch SW3 are turned off as shown in FIG. 10. Therefore, in the unit circuit R[1], the electric potential VL stored in the buffer circuit BF1 is supplied from the sampling circuit A to the selection circuit B. In the selection circuit B, since the fifth switch SW5 is turned on, and the sixth switch SW6 is turned off as shown in FIG. 10, the capacitive electric potential Vcom[1] is maintained in the high-level electric potential VcomH (1.25 V). Therefore, during this period, the electric potential Vp of the pixel electrode 41 is maintained in 5 V.

1-1-4. Write Period H[0]

In the subsequent write period H[0], the selection switch TSL is turned off as shown in FIG. 4. In this period, since the electric potential of the scanning signal G[0] is at the ON electric potential Von, and the electric potential of the scanning signal G[2] is at the OFF electric potential Voff, in the unit circuit R[1], the first switch SW1 and the fourth switch SW4 are turned on, and the second switch SW2 and the third switch SW3 are turned off as shown in FIG. 7. Therefore, in the unit circuit R[1], the electric potential VH of the polarity signal POL1 is stored in the buffer circuit BF1, and VH is supplied from the sampling circuit A to the selection circuit B. In this selection circuit B, as shown in FIG. 8, the fifth switch SW5 is turned off, and the sixth switch SW6 is turned on. Therefore, the capacitive electric potential Vcom[1] is maintained in the low-level electric potential VcomL (−1.25 V).

In this manner, at the start of the write period H[0], the capacitive electric potential Vcom[1] transitions from the high-level electric potential VcomH to the low-level electric potential VcomL. As a result, as shown in FIG. 4, the electric potential Vp of the pixel electrode 41 transitions from VdataH to VdataH−(VcomH−VcomL). Specifically, as shown in FIG. 16, the electric potential Vp transitions from 5 V to 5 V−(1.25 V+1.25 V)=2.5 V. Therefore, in the write period H[0], the electric potential Vp of the pixel electrode 41 is maintained in 2.5 V.

1-2. Subfields SF2 and SF3

In the subsequent subfields SF2 and SF3, the polarity signal POL1 (polarity signal POL2) is maintained in the electric potential VH (VL). In addition, the electric potential of the gradation signal S[n] written to the pixel electrode 41 is at VdataH (2.5 V) in either subfield SF2 or SF3. Therefore, as shown in FIG. 16, variation of the electric potential Vp of the pixel electrode 41 in each of the subfields SF2 and SF3 is equal to variation of the electric potential Vp in the subfield SF1 of the (k)th frame.

1-3. Subfield SF4

1-3-1. Write Period H[1]

The subsequent subfield SF4 also starts from the write period H[1]. In the write period H[1], the electric potential Vp of the pixel electrode 41 is maintained in VdataL (−2.5 V). Meanwhile, in this write period H[1], since the electric potentials of the scanning signals G[0] and G[2] are the OFF electric potential Voff, in the unit circuit R[1], the electric potential stored in the buffer circuit BF1 is supplied from the sampling circuit A to the selection circuit B as shown in FIG. 10. At this moment, VH is stored in the buffer circuit BF1. Therefore, in the selection circuit B, the fifth switch SW5 is turned off, and the sixth switch SW6 is turned on as shown in FIG. 8. Therefore, the capacitive electric potential Vcom[1] is maintained in the low-level electric potential VcomL (−1.25 V).

1-3-2. Write Period H[2]

In the subsequent write period H[2], as shown in FIG. 4, the selection switch TSL of the pixel circuit PIX is turned off. In addition, at the start of the write period H[2], the capacitive electric potential Vcom[1] transitions from the low-level electric potential VcomL to the high-level electric potential VcomH and maintained in the high-level electric potential VcomH (1.25 V) in the write period H[2]. Therefore, as shown in FIG. 4, the electric potential Vp of the pixel electrode 41 transitions from VdataH to VdataH+(VcomH−VcomL)=−2.5 V+(1.25 V+1.25 V)=0 V and is maintained in 0 V.

1-3-3. Period from the Start of the Write Period H[3] to the Start of the Write Period H[0]

In the subsequent period from the start of the write period H[3] to the start of the write period H[0], the same operation as that of the period from the start of the write period H[3] of the subfield SF1 of the (k)th frame to the start of the write period H[0] is made. Therefore, the capacitive electric potential Vcom[1] is maintained in the high-level electric potential VcomH (1.25 V), and the electric potential Vp of the pixel electrode 41 is maintained in 0 V.

1-3-4. Write Period H[0]

In the subsequent write period H[0], the same operation as that of the write period H[0] of the subfield SF1 of the (k)th frame is made. However, at the start of the write period H[0] of the subfield SF4 of the (k)th frame, the electric potential of the polarity signal POL1 transitions from VH to VL. Therefore, in the write period H[0], VL is stored in the buffer circuit BF1 of the unit circuit R[1], and the capacitive electric potential Vcom[1] is maintained in the high-level electric potential VcomH (1.25 V). The electric potential Vp of the pixel electrode 41 is maintained in 0 V.

2. (k+1)th Frame

In the subsequent (k+1)th frame, the same operation as that of the (k)th frame is made. However, since the electric potentials of the polarity signal POL1 and the first polarity signal POL2 are reversed one time in each frame, the polarity is positive in each of the subfield SF of the (k)th frame, but the polarity is negative in each subfield SF of the (k+1)th frame. For this reason, the capacitive electric potential Vcom[1] and the electric potential Vp of the pixel electrode 41 in the (k+1)th frame have polarity opposite to that of the electric potential Vp of the pixel electrode 41 and the capacitive electric potential Vcom[1] in the (k+1)th frame. Therefore, during the write period H[0] of the subfield SF4 of the (k+1)th frame, VH is stored in the buffer circuit BF1 of the unit circuit R[1]. This is the reason why VH is stored in the buffer circuit BF1 of the unit circuit R[1] during the write period H[1] for the subfield SF1 of the (k)th frame.

While the aforementioned description has been made focusing on the pixel circuit PIX located in the first row and the (n)th column, the aforementioned operation is made for the pixel circuit PIX located in the (m)th row and the (n)th column. Of course, the electric potential Vp of the pixel electrode 41 of the pixel circuit PIX located in the (m)th row and the (n) th column varies depending on the capacitive electric potential Vcom[m] generated by the unit circuit R[m] based on the scanning signal G[m−1] and the scanning signal G[m+1]. In addition, each frame for the pixel circuit PIX located in the (m)th row and the (n)th column starts from the write period H[m].

In this manner, the capacitive electric potential line driving circuit 23 of the liquid crystal device 200 performs a second process of supplying one of the low-level electric potential VcomL and high-level electric potential VcomH as the capacitive electric potential Vcom[m] to the capacitive electric potential line 13 corresponding to the (m)th row, in which, as the write period H[m] for the (m)th row in each subfield SF included in the frame is terminated, the polarity of the capacitive electric potential Vcom[m] is reversed, the polarity of the capacitive electric potential Vcom[m] is reversed again at the start of the write period H[m−1] after the polarity of the capacitive electric potential Vcom[m] is reversed in the subfields SF (SF1, SF2, and SF3) except for the final subfield SF4 out of the subfields SF included in the frame, and the polarity of the capacitive electric potential Vcom[m] is not reversed in the subfield SF4 after the polarity of the capacitive electric potential Vcom[m] is reversed, and the corresponding subfield SF4 is terminated. Therefore, in the liquid crystal device 200, the polarity of the voltage applied to each liquid crystal element 40 is reversed not on a subfield SF basis but on a frame basis. Therefore, in the liquid crystal device 200, for two neighboring frames, the time integral (absolute value) of the positive voltage is equal to the time integral (absolute value) of the negative voltage applied in such a frame so that the DC component is removed. Therefore it is possible avoid the remnant DC component in the liquid crystal device 200.

Figure 17:
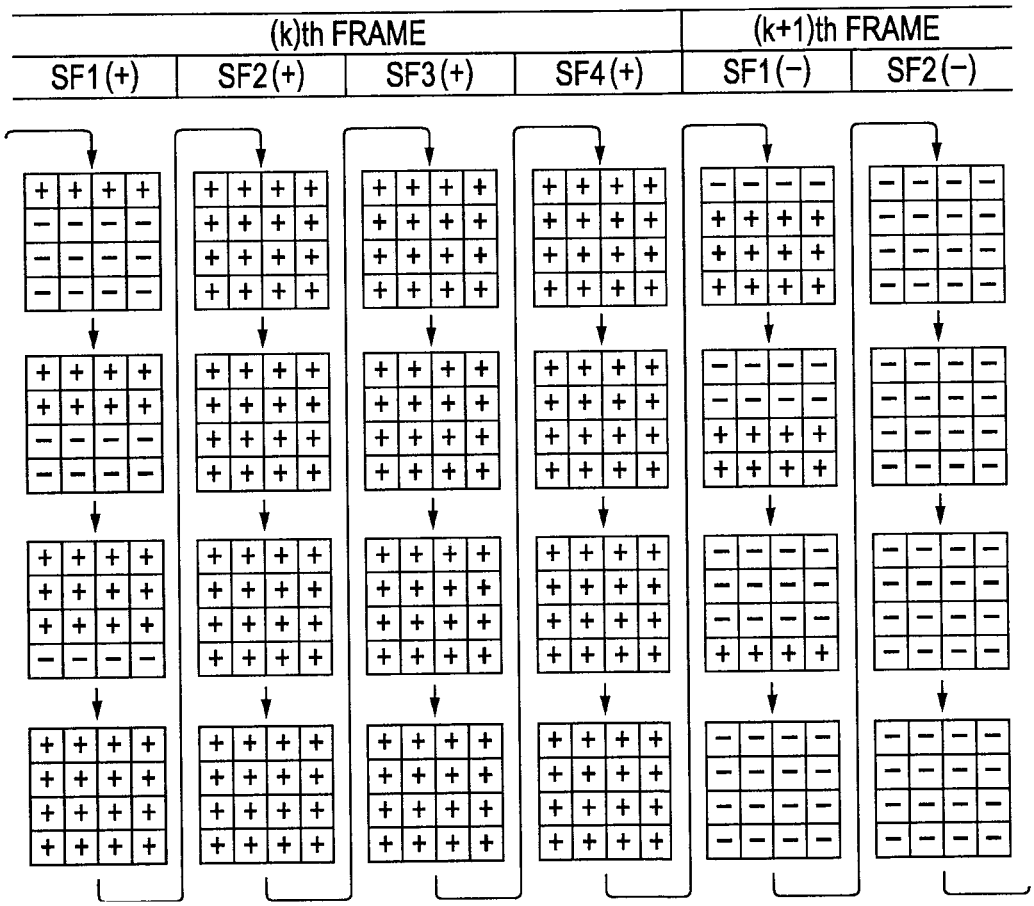
FIG. 17 is a conceptual diagram illustrating other advantages of the liquid crystal device.

In the liquid crystal device 200, since the polarity of the voltage applied to each liquid crystal element 40 is reversed on a frame basis, the image display quality is significantly improved. This will be described with reference to FIG. 17. FIG. 17 shows change of the polarity of the electric potential Vp in all of the pixel electrodes 41 of the liquid crystal device 200. However, in FIG. 17, in order to avoid a complicated illustration, the number of pixel electrodes 41 provided in the liquid crystal device 200 is set to 4 rows×4 columns=16. In the liquid crystal device 200, the polarity of the voltage applied to the liquid crystal element 40 is reversed in each frame. Therefore, the frequency that a portion (shown as the thick solid line in FIG. 17) in which the electric potential of the pixel electrode 41 is significantly different between the neighboring rows scans the display area is set to a single time per single frame. Since this is remarkably smaller than 4 times per single frame, the image display quality is significantly improved in the liquid crystal device 200.

3. Third Embodiment

Figure 18:
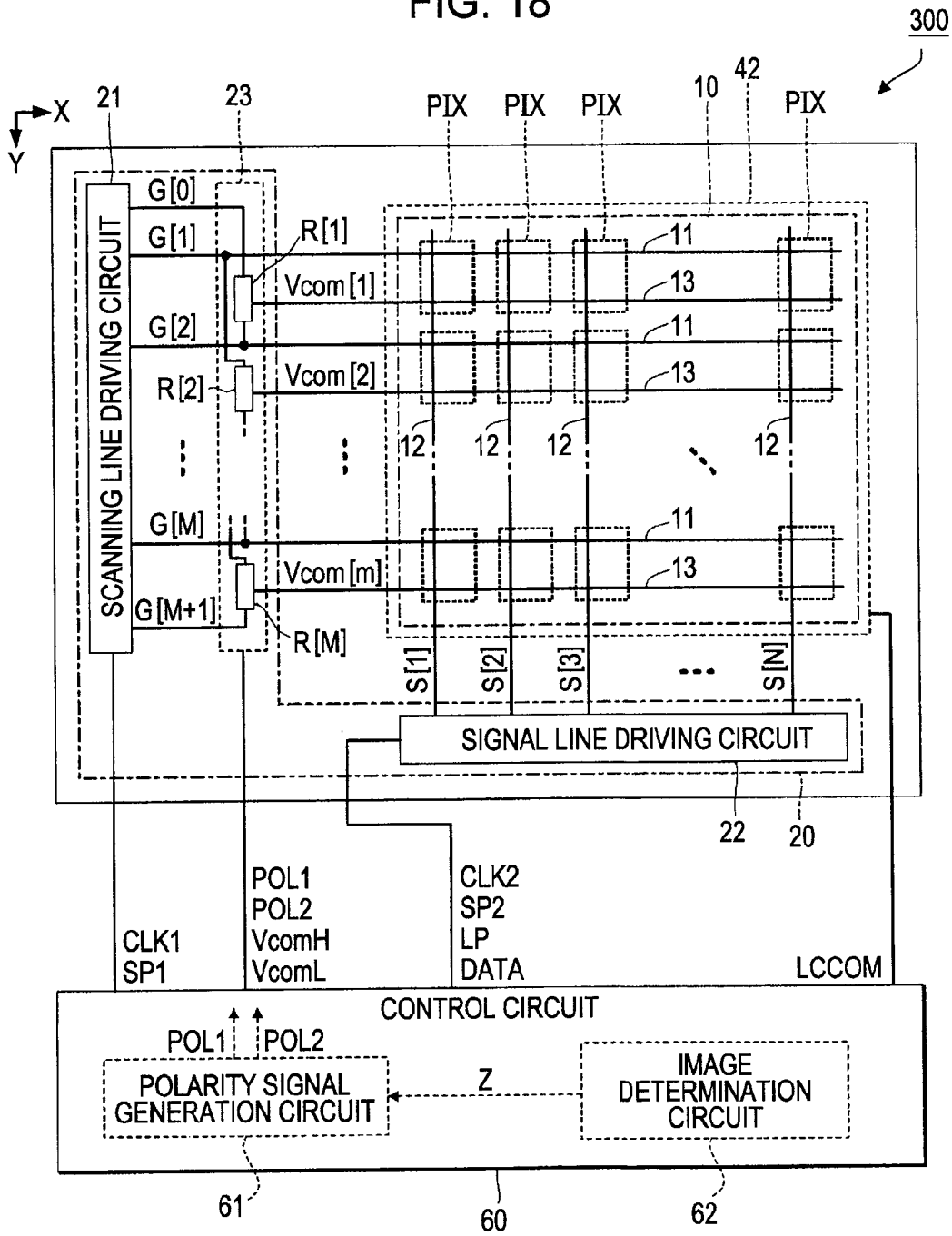
FIG. 18 is a block diagram illustrating a configuration of the liquid crystal device according to the third embodiment of the invention.

FIG. 18 is a block diagram illustrating a configuration of the liquid crystal device 300 according to the third embodiment of the invention. The liquid crystal device 300 is employed in various electronic apparatuses as a display body for displaying images and is structured in a combination of the liquid crystal devices 100 and 200. The liquid crystal device 300 is characterized in that the capacitive electric potential line driving circuit 23 selectively performs one of the first process of the liquid crystal device 100 and the second process of the liquid crystal device 200 depending on the type of the image to be displayed (moving picture/still image).

The liquid crystal device 300 is different from the liquid crystal device 100 or 200 only in that the control circuit 60 is provided instead of the control circuit 30 or 50. The control circuit 60 is different from the control circuit 30 or 50 in that the polarity signal generation circuit 61 is provided instead of the polarity signal generation circuit, 31 or 51, and an image determination circuit 62 is further provided. The image determination circuit 62 is sequentially supplied with the image data from an upper-level device (e.g., computer) other than the control circuit 60 in each frame. The image data corresponding to a single frame represent gradations of each pixel arranged in M rows and N columns (from the (0)th gradation to fifteenth gradation).

The image determination circuit 62 includes a frame buffer capable of storing image data corresponding to a plurality of frames. The image determination circuit 62 compares gradations of corresponding pixels between the neighboring frames using this frame buffer and supplies a type assignment signal Z depending on the comparison result to the polarity signal generation circuit 61. The type assignment signal Z is used to assign the type of the image and assigns a still image in the case where the gradations of all pixels match with each other between the neighboring frames or a moving picture in other cases.

The polarity signal generation circuit 61 generates polarity signals POL1 and POL2 based on the supplied type assignment signal Z and supplies them to the capacitive electric potential line driving circuit 23. Specifically, in the case where the type assignment signal Z for assigning the moving picture is supplied, the polarity signal generation circuit 61 generates the polarity signals POL1 and POL2 having waveforms shown in FIG. 12. In the case where the type assignment signal Z for assigning the still image is supplied, the polarity signal generation circuit 61 generates the polarity signals POL1 and POL2 having waveforms shown in FIG. 16. The polarity signal generation circuit 61 may have any configuration. For example, the polarity signal generation circuit 61 may include polarity signal generation circuits 31 and 51 and activate only the one that responds to the supplied type assignment signal Z.

The liquid crystal device 300 performs the first process appropriate to suppress the maximum value (absolute value) of the temporally remaining DC component in the case where a still image susceptible to an afterimage phenomenon is displayed and performs the second process appropriate to improve the display quality in the case where a moving picture insusceptible to the afterimage phenomenon is displayed. Therefore, it is possible to suppress degradation of each liquid crystal element 40 more effectively in comparison with the liquid crystal device 200 while the same display quality as that of the liquid crystal device 200 is obtained.

4. Fourth Embodiment

Figure 19:
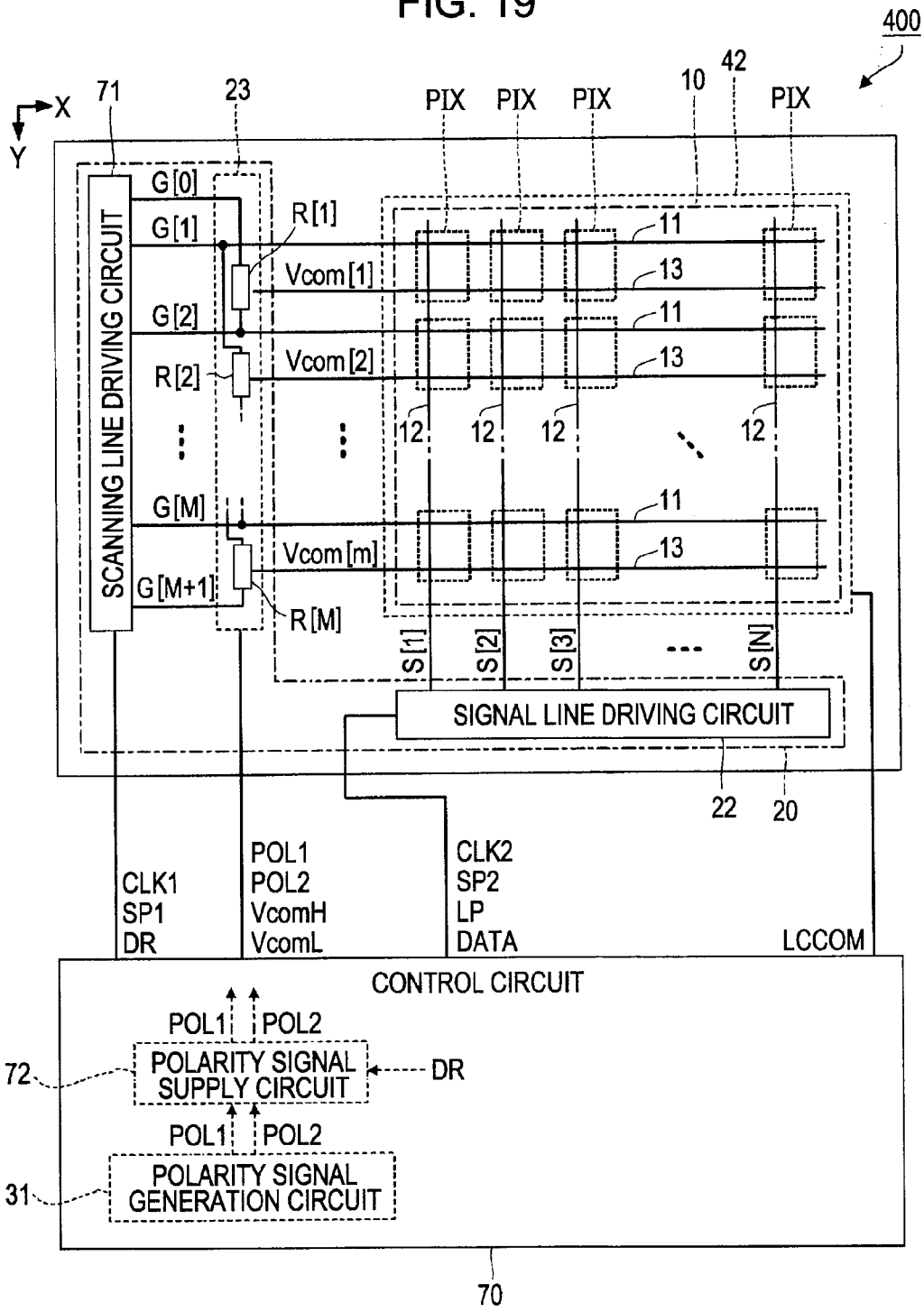
FIG. 19 is a block diagram illustrating a configuration of the liquid crystal device according to the fourth embodiment of the invention.

FIG. 19 is a block diagram illustrating a configuration of the liquid crystal device 400 according to the fourth embodiment of the invention. The liquid crystal device 400 is employed in various electronic apparatuses as a display body for displaying images and has the same configuration as that of the liquid crystal device 100 of FIG. 1. However, in the liquid crystal device 400, a selection direction for the M scanning lines 11 can switch between the forward direction which is a selection direction of the liquid crystal device 100 and the backward direction opposite to the forward direction.

For this reason, the liquid crystal device 400 includes a scanning line driving circuit 71 that switches the selection direction based on the selection direction signal DR for assigning the selection direction (forward/backward) and a control circuit 70 that supplies the selection direction signal DR to the scanning line driving circuit 71 instead of the scanning line driving circuit 21 and the control circuit 30. In addition, the selection direction signal DR may be generated in the control circuit 70, or may be supplied to the control circuit 70 from an upper-level device (e.g., computer) other than the control circuit 70.

Figure 20:
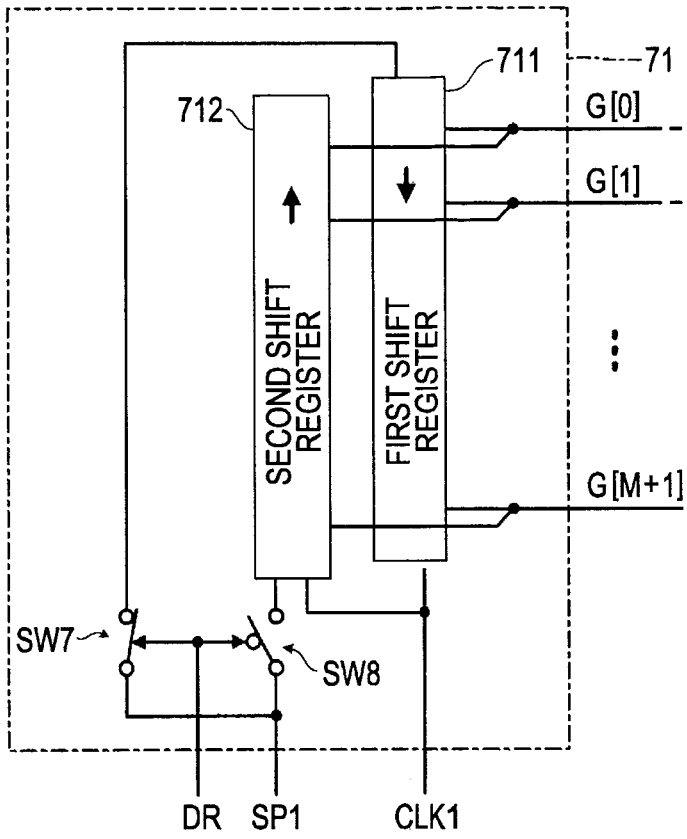
FIG. 20 is a block diagram illustrating a configuration of a scanning line driving circuit of the liquid crystal device.

FIG. 20 is a block diagram illustrating a configuration of the scanning line driving circuit 71. As shown in FIG. 20, the scanning line driving circuit 71 includes the switches SW7 and SW8, a first shift register 711 having (M+2) stages to which the start pulse SP1 is supplied through the switch SW7, and a second shift register 712 having (M+2) stages to which the start pulse SP1 is supplied through the switch SW8. The first shift register 711 transmits the supplied start pulse SP1 to the next stage located in the forward direction at the timing assigned by the clock signal CLK1. The second shift register 712 transmits the supplied start pulse SP1 to the next stage located in the backward direction at the timing assigned by the clock signal CLK1.

The switch SW7 is turned on when the selection direction signal DR represents the forward direction and turned off when it represents the backward direction. The switch SW8 is turned off when the selection direction signal DR represents the forward direction and turned on when it represents the backward direction. Therefore, the start pulse SP1 is shifted in the first shift register 711 when the selection direction signal DR represents the forward direction and shifted in the second shift register 712 when the selection direction signal DR represents the backward direction. In addition, the electric potentials of each stage of the shift register used to shift the start pulse SP1 are set to the electric potentials of the scanning signals G[0] to G[M+1].

Therefore, in the liquid crystal device 400, the selection direction for the M scanning lines 11 becomes a forward direction when the selection direction signal DR represents the forward direction or becomes a backward direction when the selection direction signal DR represents the backward direction. Meanwhile, the control circuit 70 is different from the control circuit 30 in that the selection direction signal DR is also supplied to the scanning line driving circuit 71, that the sequence of the gradation data of the image signal DATA is set to a descending order for each column when the selection direction for the M scanning lines 11 is set to the backward direction, and that the polarity signal supply circuit 72 is additionally provided.

The polarity signal supply circuit 72 interchanges polarity signals POL1 and POL2 in synchronization with the selection direction for the M scanning lines 11. The polarity signals POL1 and POL2 generated by the polarity signal generation circuit 31 are supplied to the capacitive electric potential line driving circuit 23 through the polarity signal supply circuit 72.

Figure 21:
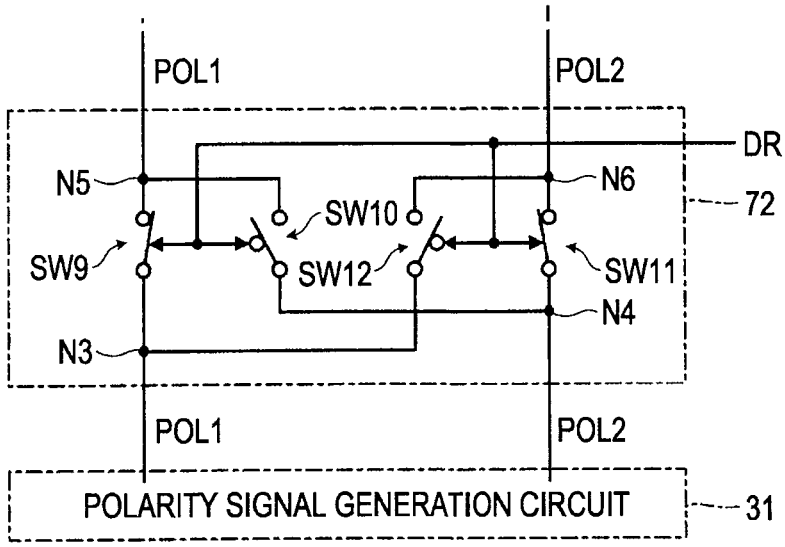
FIG. 21 is a circuit diagram illustrating a configuration of a polarity signal supply circuit of the liquid crystal device.

FIG. 21 is a circuit diagram illustrating a configuration of the polarity signal supply circuit 72. Referring to FIG. 21, the polarity signal supply circuit 72 includes switches SW9 to SW12 and nodes N3 to N6. The nodes N3 and N5 are connected to each other through the switch SW9, and the nodes N4 and N6 are connected to each other through the switch SW11. The node N3 is connected to the node N6 through the switch SW12, and the nodes N4 and N5 are connected to each other through the switch SW10.

The node N3 is supplied with the polarity signal POL1 from the polarity signal generation circuit 31. The node N4 is supplied with the polarity signal POL2 from the polarity signal generation circuit 31. The polarity signal supply circuit 72 supplies the signal supplied to the node N5 to the capacitive electric potential line driving circuit 23 as the polarity signal POL1 and supplies the signal supplied to the node N6 to the capacitive electric potential line driving circuit 23 as the polarity signal POL2.

The polarity signal supply circuit 72 is supplied with the polarity signal generation circuit 31. The switches SW9 and SW11 are turned on when the supplied selection direction signal DR represents the forward direction and turned off when the selection direction signal DR represents the backward direction. Meanwhile, the switches SW10 and SW12 are turned off when the supplied selection direction signal DR represents the forward direction and turned on when the selection direction signal DR represents the backward direction.

If the selection direction signal DR representing the forward direction is supplied, only the switches SW9 and SW11 out of the switches SW9 to SW12 are turned on so that the nodes N3 and N5 are connected, and the nodes N4 and N6 are connected. The polarity signal supply circuit 72 supplies the polarity signal POL1 supplied from the polarity signal generation circuit 31 to the capacitive electric potential line driving circuit 23 as the polarity signal POL1 and supplies the polarity signal POL2 supplied from the polarity signal generation circuit 31 to the capacitive electric potential line driving circuit 23 as the polarity signal POL2.

Meanwhile, if the selection direction signal DR representing the backward direction is supplied, only the switches SW10 and SW12 out of the switches SW9 to SW12 are turned on, so that the nodes N3 and N6 are connected, and the nodes N4 and N5 are connected. Therefore, the polarity signal supply circuit 72 supplies the polarity signal POL1 supplied from the polarity signal generation circuit 31 to the capacitive electric potential line driving circuit 23 as the polarity signal POL2 and supplies the polarity signal POL2 supplied from the polarity signal generation circuit 31 to the capacitive electric potential line driving circuit 23 as the polarity signal POL1.

In other words, in the capacitive electric potential line driving circuit 23, the polarity signals POL1 and POL2 are interchanged between when the M scanning lines 11 are selected in the forward direction and when they are selected in the backward direction. That is, the polarity signals POL1 and POL2 supplied to the capacitive electric potential line driving circuit 23 have the waveforms shown in FIG. 12 when the M scanning lines 11 are selected in the forward direction, and the polarity signals POL1 and POL2 supplied to the capacitive electric potential line driving circuit 23 have the waveforms shown in FIG. 22 when the M scanning lines 11 are selected in the backward direction.

Figure 22:
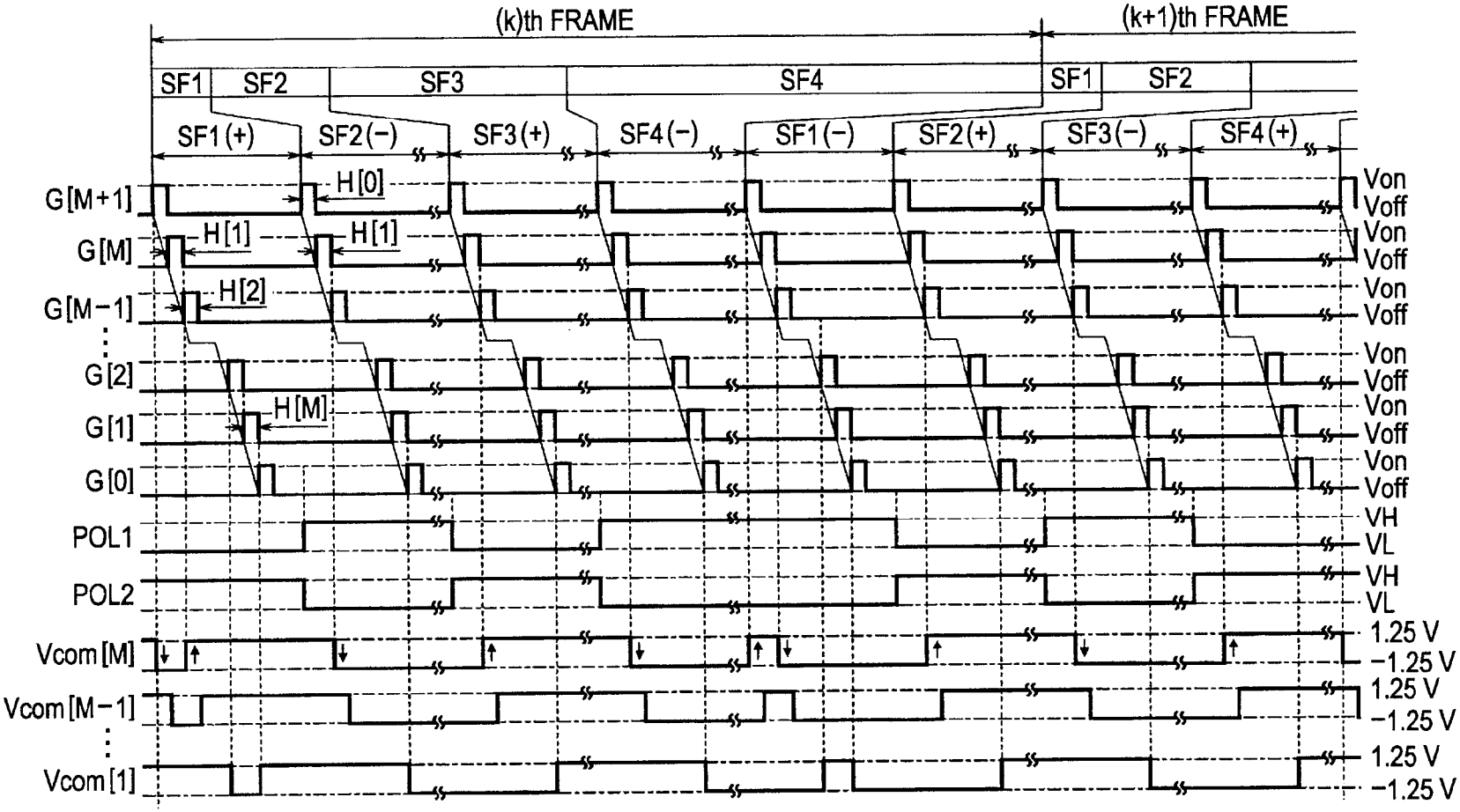
FIG. 22 is a timing chart illustrating fluctuation of the voltage in each part of the liquid crystal device.

Since the unit circuit R[m] of the capacitive electric potential line driving circuit 23 is configured as shown in FIG. 6, even when the selection direction for the M scanning lines 11 is set to the backward direction, it is possible to obtain the appropriate capacitive electric potential Vcom[m] in the selection direction for the M scanning lines 11 as shown in FIG. 22 just by interchanging the polarity signals POL1 and POL2. This is the reason why the polarity signals POL1 and POL2 interchanged when the selection direction for the M scanning lines 11 is set to the backward.

As apparent from the aforementioned descriptions, the liquid crystal device 400 can switch the selection direction for the M scanning lines 11 between the forward and backward directions without losing advantages of the liquid crystal device 100. In addition, as another advantage of the liquid crystal device 400, the aforementioned advantages can be obtained just by interchanging the polarity signals POL1 and POL2 in synchronization with the selection direction for the M scanning lines 11.

5. Fifth Embodiment

Figure 23:
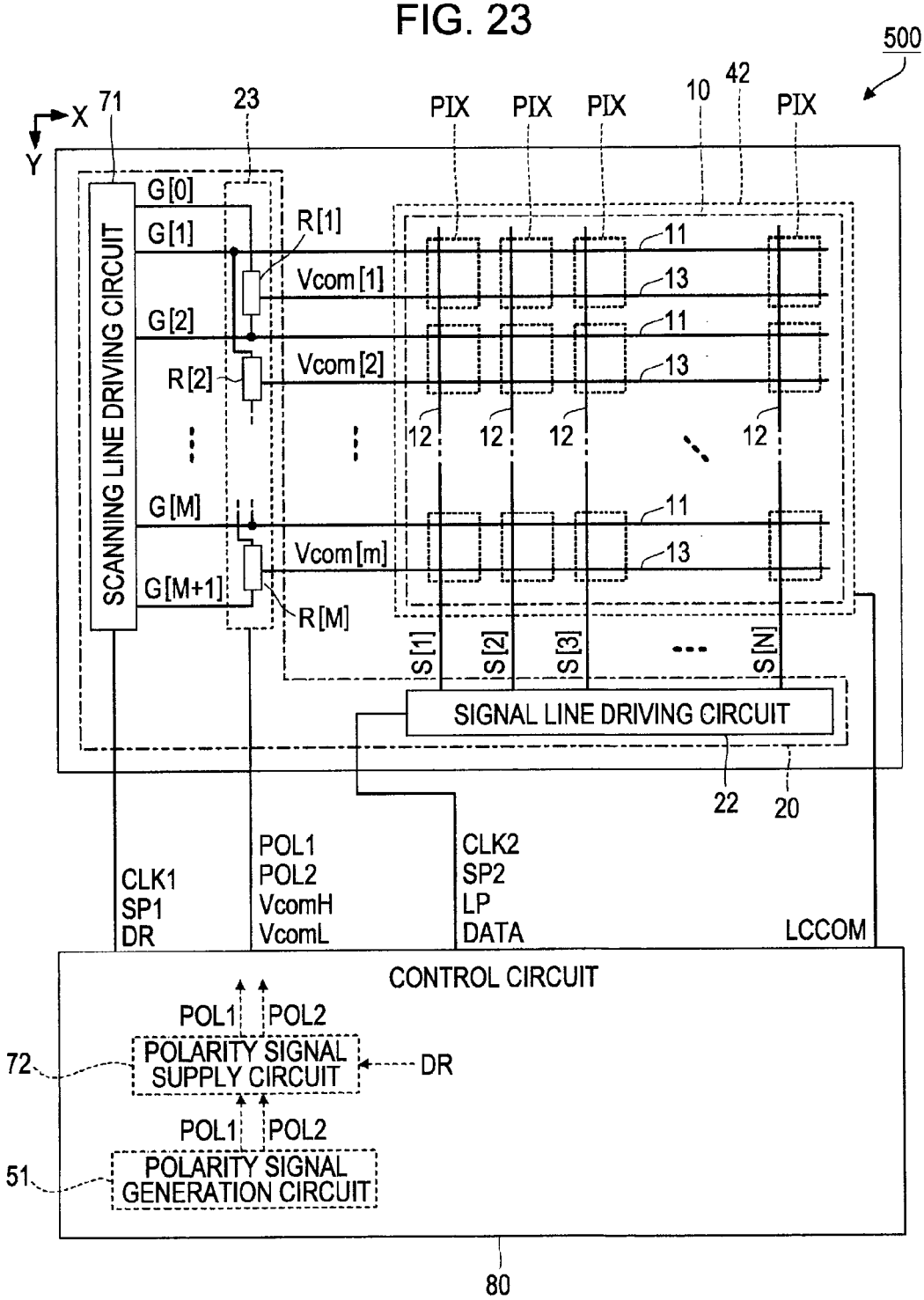
FIG. 23 is a block diagram illustrating a configuration of the liquid crystal device according to the fifth embodiment of the invention.

FIG. 23 is a block diagram illustrating a configuration of the liquid crystal device 500 according to the fifth embodiment of the invention. The liquid crystal device 500 is employed in various electronic apparatuses as a display body for displaying images and has the same configuration as that of the liquid crystal device 400 of FIG. 19. However, similar to the liquid crystal device 200, in the liquid crystal device 500, during the AC driving using the driving circuit 20, the (positive/negative) polarity of the voltage applied to each liquid crystal element 40 is reversed not on a subfield basis but on a frame basis. For this reason, the liquid crystal device 500 includes a control circuit 80 instead of the control circuit 70. The control circuit 80 is different from the control circuit 70 in only that the polarity signal generation circuit 51 is provided instead of the polarity signal generation circuit 31.

Figure 24:
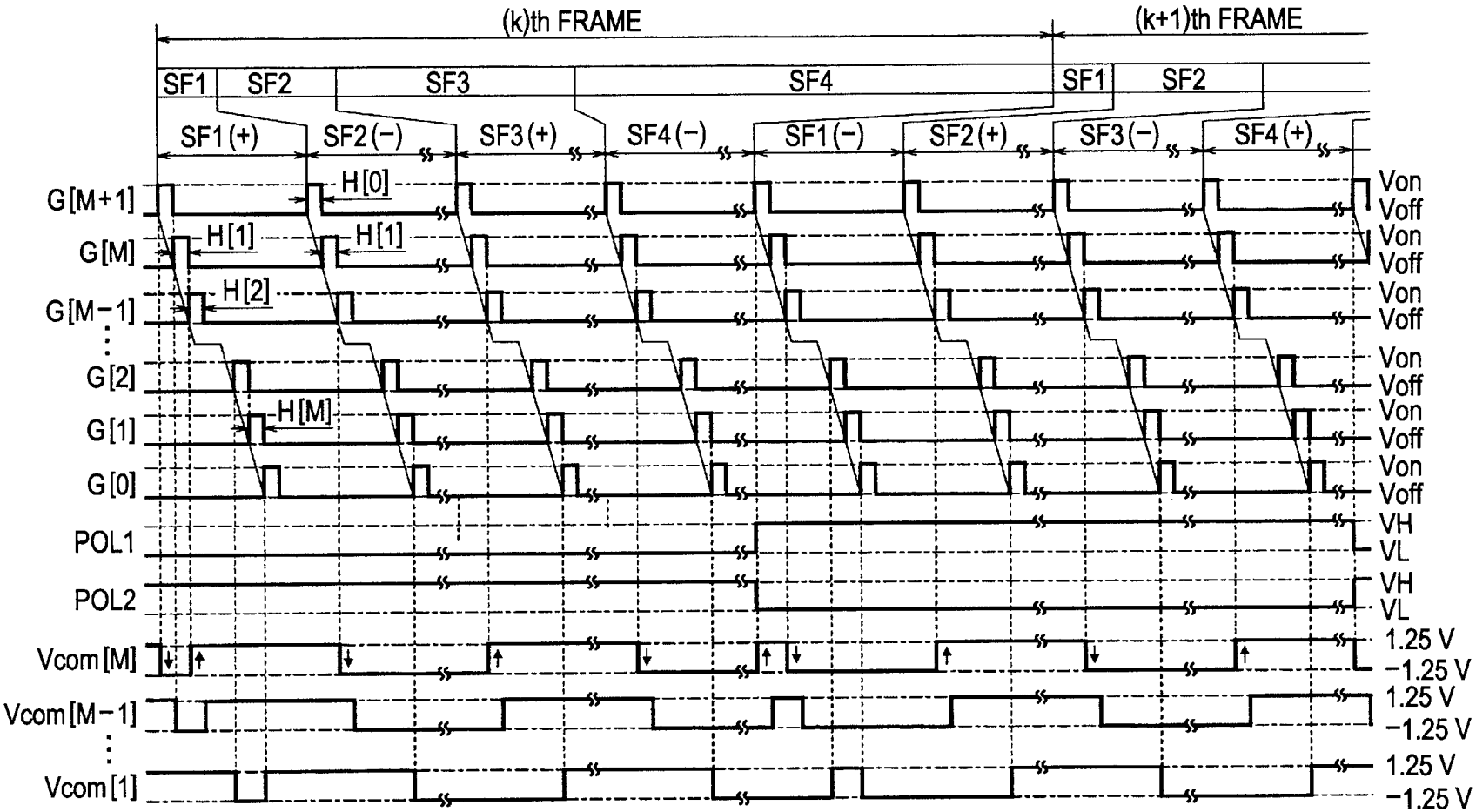
FIG. 24 is a timing chart illustrating fluctuation of the voltages in each part of the liquid crystal device.

Due to such a configuration, the polarity signals POL1 and POL2 supplied to the capacitive electric potential line driving circuit 23 of the liquid crystal device 500 have the waveforms shown in FIG. 16 when the M scanning lines 11 are selected in the forward direction, and the polarity signals POL1 and POL2 supplied to the capacitive electric potential line driving circuit 23 have the waveforms shown in FIG. 24 when the M scanning lines 11 are selected in the backward direction.

As a result, the liquid crystal device 500 can switch the selection direction for the M scanning lines 11 between the forward and backward directions without losing advantages of the liquid crystal device 200. In addition, as another advantage of the liquid crystal device 500, the aforementioned advantages can be obtained just by interchanging the polarity signals POL1 and POL2 in synchronization with the selection direction for the M scanning lines 11.

6. Modified Examples

The aforementioned embodiments can be variously modified. The modified examples will be described in detail by way of examples hereinafter. In the following examples, two or more aspects may be arbitrarily selected and combined.

1. Modified Example 1

The third embodiment described above may be modified such that the polarity signals POL1 and POL2 are interchanged in synchronization with the selection direction for the M scanning lines 11. In other words, the third and fourth embodiments described above may be combined, or the third and fifth embodiments described above may be combined.

2. Modified Example 2

The third embodiment described above may be modified such that the type assignment signal Z for assigning the type (moving picture/still image) of the image to be displayed may be supplied from an upper-level device (e.g., computer) other than the control circuit 60. In addition, the type assigned by the type assignment signal Z may include other forms in addition to the moving picture and the still image. That is, the type assignment signal Z may be used to assign computer graphics such as a menu image and natural images such as a photograph. In this case, since computer graphics are more susceptible to an afterimage phenomenon than the natural image, it is preferable that the first process appropriate to suppress the maximum value (absolute value) of the temporarily remaining DC component is performed when the computer graphics are displayed, and the second process appropriate to improve display quality is performed when the natural image is displayed.

3. Modified Example 3

While the number of subfields SF within a frame is set to 4, and the number of gradations that can be displayed in the frame is set to 16, and the time lengths of each subfield SF in a single frame have a binary weighted relationship in the aforementioned embodiments, the invention is not limited thereto. However, it is necessary to set the number of subfields SF within the frame to an even number and set different lengths (weights) of the subfields within the frame because it is possible to prevent the remnant DC component without performing the first or second process when the number of subfields SF within the frame is set to an odd number, or when the lengths of the subfields within the frame are equal. In addition, when the number of subfields SF within the frame is set to q (even number), the polarity of the capacitive electric potential Vcom[m] is reversed q+1 (odd number) times for each frame in the first process and reversed 2×q−1 (odd number) times for each frame in the second process. In addition, periods other than the frame may be set to a unit period.

4. Modified Example 4

The configuration of the pixel circuit PIX may be appropriately modified. For example, a circuit element such as a capacitance element or switch may be added to the pixel circuit PIX, and a liquid crystal element having a normally white mode in which the gradation has a maximum value (white) when the applied voltage is at 0 V may be employed as the liquid crystal element 40. While the common electric potential LCCOM is set to 0 V, VdataH is set to 2.5 V, and VdataL is set to −2.5 V in the aforementioned embodiments, the invention is not limited thereto. For example, LCCOM may be set to 2.5 V, VdataH may be set to 5 V, and VdataL may be set to 0 V.

5. Modified Example 5

While the high-level electric potential VcomH is set to 1.25 V, and the low-level electric potential VcomL is set to −1.25 V in the aforementioned embodiments, the invention is not limited thereto.

6. Modified Example 6

While the polarity signals POL1 and POL2 have an opposite relationship in terms of the electric potential in the aforementioned embodiment, the polarity signals POL1 and POL2 may have other relationships depending on the configuration of the liquid crystal device. In other words, the capacitive electric potential line driving circuit 23 may be applied to liquid crystal devices having various configurations (for example, a liquid crystal device in which each row corresponds to a plurality of scanning lines) by appropriately setting the polarity signals POL1 and POL2.

7. Modified Example 7

Since, in the first process performed by the capacitive electric potential line driving circuit 23 according to each of the first, third, and fourth embodiments, the polarity of the capacitive electric potential Vcom[m] is reversed again at the start of the write period H[m−1] in the subfield SF4 after the polarity of the capacitive electric potential Vcom[m] is reversed, it is possible to reliably complete the repeated reversing before the start of the next write period H[m] and also sufficiently suppress degradation of the gradation display accuracy caused by the repeated reversing. However, operations executed by the first process are not limited thereto.

For example, focusing on the suppression of degradation in accuracy rather than reliable completeness, in the subfield SF4, the polarity of the capacitive electric potential Vcom[m] may be reversed again in the write period H[m−1] after the polarity of the capacitive electric potential Vcom[m] is reversed. For example, focusing on reliable completeness rather than the suppression of degradation in accuracy, in the subfield SF4, the polarity of the capacitive electric potential Vcom[m] may be reversed again after the polarity of the capacitive electric potential Vcom[m] is reversed until the write period H[m−1] is initiated. For example, focusing on neither the suppression of degradation in accuracy nor reliable completeness, in the subfield SF4, the polarity of the capacitive electric potential Vcom[m] may be reversed again after the capacitive electric potential Vcom[m] is reversed until the corresponding subfield SF4 is terminated.

Since, in the second process executed by the capacitive electric potential line driving circuit 23 according to each of the second, third, and fifth embodiments, the polarity of the capacitive electric potential Vcom[m] is reversed again at the start of the write period H[m−1] after the polarity of the capacitive electric potential Vcom[m] is reversed in each of the subfields SF1, SF2, and SF3, it is possible to reliably complete the repeated reversing before the next write period H[m] and sufficiently suppress degradation in accuracy for displaying gradations caused by the repeated reversing. However, operations executed by the second process are not limited thereto.

For example, focusing on the suppression of degradation in accuracy rather than reliable completeness, in each of the subfields SF1, SF2, and SF3, the polarity of the capacitive electric potential Vcom[m] may be reversed again in the write period H[m−1] after the polarity of the capacitive electric potential Vcom[m] is reversed. For example, focusing on reliable completeness rather than the suppression of degradation in accuracy, in each of the subfields SF1, SF2, and SF3, the polarity of the capacitive electric potential Vcom[m] may be reversed again after the polarity of the capacitive electric potential Vcom[m] is reversed until the write period H[m−1] is initiated. For example, focusing on neither the suppression of degradation in accuracy nor reliable completeness, in each of the subfields SF1, SF2, and SF3, the polarity of the capacitive electric potential Vcom[m] may be reversed again after the capacitive electric potential Vcom[m] is reversed until the corresponding subfield SF is terminated.

In addition, since the lengths of the write periods H[0] to H[M+1] are common, and the write period H[m] is initiated as the write period H[m−1] is terminated, the time point when the write period H[m−1] is initiated in the subfield SF also corresponds to the time point preceding W from end of the corresponding subfield SF when each of the lengths of the write periods H[0] to H[M+1] is set to W, and the time point when the corresponding write period H[m−1] is terminated also corresponds to the time point when the corresponding subfield SF is terminated. In the aforementioned descriptions, it is assumed that the selection direction for the M scanning lines 11 is set to the forward direction. In the case where the selection direction is set to the backward direction, the H[m−1] may be exchanged with H[m+1] in the aforementioned descriptions.

7. Applications

Figure 25:
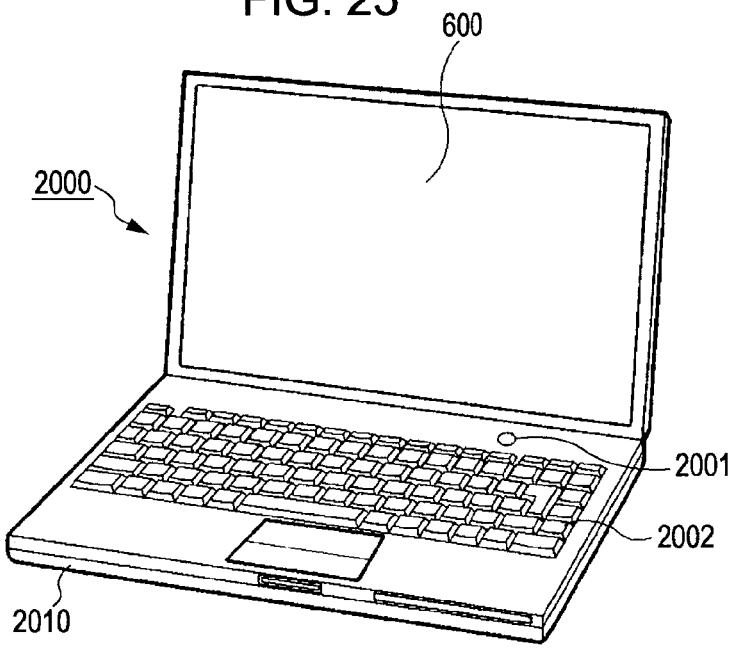
FIG. 25 is a perspective view illustrating an appearance of the electronic apparatus according to an embodiment of the invention.
Figure 26:
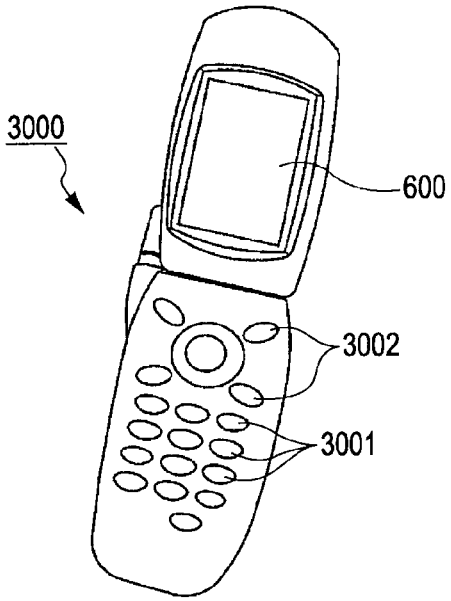
FIG. 26 a perspective view illustrating an appearance of another example of the electronic apparatus according to an embodiment of the invention.
Figure 27:
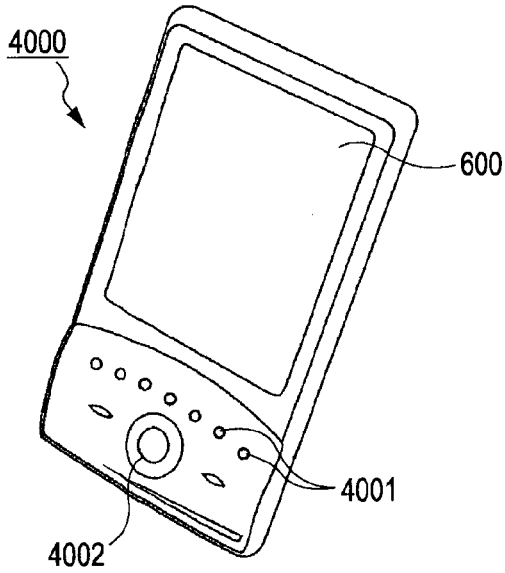
FIG. 27 is a perspective view illustrating an appearance of still another example of the electronic apparatus according to an embodiment of the invention.

Next, an electronic apparatus using the liquid crystal device according to the aforementioned aspects will be described. FIGS. 25 to 27 illustrate an electronic apparatus in which the liquid crystal device is employed as the display device 600.

FIG. 25 is a perspective view illustrating a configuration of a transportable personal computer employing the display device 600. The personal computer 2000 includes a display device 600 for displaying various images and a mainframe unit 2010 including a power switch 2001, a keyboard 2002, or the like.

FIG. 26 is a perspective view illustrating a configuration of a mobile phone having the display device 600. The mobile phone 3000 includes a plurality of manipulation buttons 3001, a scroll button 3002, and a display device 600 for displaying various images. A display area displayed on the display device 600 is scrolled by manipulating the scroll button 3002.

FIG. 27 is a perspective view illustrating a configuration of a personal digital assistant (PDA) having the display device 600. The PDA 4000 includes a plurality of manipulation buttons 4001, a power switch 4002, and a display device 600 for displaying various images. As the power switch 4002 is manipulated, various kinds of information such as an address book or a schedule list are displayed on the display device 600.

The electronic apparatus having the liquid crystal device according to the invention may include a projector, a digital camera, a television, a video camera, a car navigation device, a pager, an electronic notepad, an electronic paper, a calculator, a word processor, a work station, an image phone, a POS terminal, a printer, a scanner, a copy machine, a video player, a touch panel device, or the like in addition to those illustrated in FIGS. 25 to 27.

The entire disclosure of Japanese Patent Application No. 2009-263670, filed Nov. 19, 2009 is expressly incorporated by reference herein.

What is claimed is:

1. A liquid crystal device comprising:

signal lines;

scanning lines;

capacitive electric potential lines;

pixels corresponding to each intersection of the signal lines and the scanning lines, each of the pixels including a selection switch, a pixel electrode, and a retentive capacitor interposed between the pixel electrode and one of the capacitive electric potential lines;

a signal line driving circuit that supplies one of a first electric potential and a second electric potential to the signal lines in a write period included in each of subfield periods of a unit period, the unit period including even-numbered subfield periods having at least different lengths;

a scanning line driving circuit that sequentially selects the scanning lines and supplies a scanning signal for turning on the selection switch in each write period; and a capacitive electric potential line driving circuit that supplies one of a low-level electric potential and a high-level electric potential as a capacitive electric potential to each of the capacitive electric potential lines, reverses polarity of the capacitive electric potential as the write period for the row corresponding to the corresponding capacitive electric potential line is terminated in each subfield period included in the unit period, and, in a final subfield period included in the unit period, reverses polarity of the capacitive electric potential again at the time period of after reversing the polarity of the capacitive electric potential until terminating the corresponding final subfield period;

wherein the liquid crystal device is configured such that the polarity of the capacitive electric potential of the final subfield period is reversed twice during said final subfield period so that the polarity of the capacitive electric potential of the write period in said final subfield period is the same as the polarity of the capacitive electric potential of the write period of a subfield period consecutive to said final subfield period.

2. The liquid crystal device according to claim 1, further comprising a polarity signal generation circuit that generates a first polarity signal and a second polarity signal, the capacitive electric potential line driving circuit selects either one of the low-level electric potential and the high-level electric potential as the capacitive electric potential based on the first polarity signal in the write period assigned by the scanning signal corresponding to a row preceding a single row from the row of the corresponding capacitive electric potential line, maintains the immediately previous capacitive electric potential in the write period of the corresponding row, and in the write period assigned by the scanning signal corresponding to the row following the row of the corresponding capacitive electric potential line by a single row, selects one of the low-level electric potential and the high-level electric potential as the capacitive electric potential based on a second polarity signal.

3. The liquid crystal device according to claim 2, wherein the capacitive electric potential line driving circuit includes a sampling circuit provided in each of the capacitive electric potential lines, and a selection circuit that selects one of the low-level electric potential and the high-level electric potential based on output signals of the sampling circuit, wherein the sampling circuit includes a first switch having one terminal to which the first polarity signal is supplied and the other terminal connected to a first node, a second switch having one terminal to which the first node is connected, a third switch having one terminal to which the second polarity signal is supplied and the other terminal connected to the first node, a buffer circuit having an input terminal connected to the first node and an output terminal connected to a second node, and a fourth switch having one terminal connected to the second node and the other terminal connected to the other terminal of the second switch, and wherein control terminals of the first and second switches are supplied with the scanning signal corresponding to a row preceding a single row from the row of the corresponding capacitive electric potential line to exclusively turn on the first and second switches, and control terminals of the first and third switches are supplied with the scanning signal corresponding to a row following a single row from the row of the corresponding capacitive electric potential line to exclusively turn on the third and fourth switches.

4. The liquid crystal device according to claim 3, further comprising a polarity signal supply circuit that interchanges the first polarity signal with the second polarity signal in synchronization with a selection direction for a plurality of scanning lines.

5. An electronic apparatus comprising a liquid crystal device according to claim 1.

* * * * *